US009666141B2

(12) United States Patent
Park et al.

(10) Patent No.: US 9,666,141 B2
(45) Date of Patent: May 30, 2017

(54) DISPLAY APPARATUS AND METHOD OF DRIVING THE SAME

(71) Applicant: Samsung Display Co., LTD., Yongin, Gyeonggi-Do (KR)

(72) Inventors: Jae Byung Park, Seoul (KR); Seon-Tae Yoon, Seoul (KR); Jae-Woong Kang, Jeonju-si (KR); Hae-Il Park, Seoul (KR); Sung-Tae Shin, Suwon-si (KR); Mun-Ki Sim, Seoul (KR); Kwang-Keun Lee, Osan-si (KR); Hyun-Min Cho, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 638 days.

(21) Appl. No.: 13/888,565

(22) Filed: May 7, 2013

(65) Prior Publication Data

US 2014/0152724 A1 Jun. 5, 2014

(30) Foreign Application Priority Data

Dec. 3, 2012 (KR) ..... 10-2012-0139185

(51) Int. Cl.
*G09G 3/34* (2006.01)

(52) U.S. Cl.
CPC ... *G09G 3/3413* (2013.01); *G09G 2310/0235* (2013.01)

(58) Field of Classification Search
CPC ..... G09G 3/3413; G09G 2310/0235
See application file for complete search history.

(56) References Cited

U.S. PATENT DOCUMENTS

| | | | | |
|---|---|---|---|---|
| 7,893,915 | B2 | 2/2011 | Woo et al. | |
| 2007/0268231 | A1 | 11/2007 | Kang et al. | |
| 2010/0141871 | A1* | 6/2010 | Hsu | G02F 1/133514 349/68 |

(Continued)

FOREIGN PATENT DOCUMENTS

| | | | |
|---|---|---|---|
| CN | 101441351 | A | 5/2009 |
| KR | 1020070002452 | A | 1/2007 |
| KR | 1020070090427 | A | 9/2007 |

(Continued)

OTHER PUBLICATIONS

Chinese Office Action for Application No. 201310379489.3 dated Mar. 28, 2017 enumerating the above reference.

*Primary Examiner* — Latanya Bibbins
(74) *Attorney, Agent, or Firm* — Cantor Colburn LLP

(57) ABSTRACT

A display apparatus includes a display panel including a first subpixel having a first primary color, a second subpixel having a second primary color; and a transparent subpixel; a panel driver which sets grayscale data of the first subpixel, the second subpixel and the transparent subpixel; a light source part which provides light to the display panel, where the light source comprises a first light source and a second light source having colors different from each other; and a light source driver which turns on the first light source during a first subframe, turns on the second light source during a second subframe, and turns on the first light source during a third subframe, and a first frame comprises the first subframe, the second subframe and the third subframe.

17 Claims, 20 Drawing Sheets

(56) References Cited

U.S. PATENT DOCUMENTS

| | | | | |
|---|---|---|---|---|
| 2012/0162270 | A1* | 6/2012 | Fleck | G09G 3/3413 345/690 |
| 2012/0182331 | A1* | 7/2012 | Hinton | G09G 3/3413 345/690 |

FOREIGN PATENT DOCUMENTS

| | | | |
|---|---|---|---|
| KR | 1020070115184 | A | 12/2007 |
| KR | 1020080002301 | A | 1/2008 |

* cited by examiner

DISPLAY APPARATUS AND METHOD OF DRIVING THE SAME

This application claims priority to Korean Patent Application No. 10-2012-0139185, filed on Dec. 3, 2012, and all the benefits accruing therefrom under 35 U.S.C. §119, the contents of which in its entirety is herein incorporated by reference.

BACKGROUND

1. Field

Exemplary embodiments of the invention relate to a display apparatus and a method of driving the display apparatus. More particularly, exemplary embodiments of the invention relate to a display apparatus with reduced power consumption and a method of driving the display apparatus.

2. Description of the Related Art

Generally, a liquid crystal display apparatus includes a liquid crystal display panel that displays an image using a light transmittance of a liquid crystal and a light source module that provides light to the liquid crystal display panel. The light source module may be a backlight assembly.

The liquid crystal display panel typically includes a first substrate having pixel electrodes and thin film transistors connected to the pixel electrodes, a second substrate having a common electrode and color filters, and a liquid crystal layer disposed between the first and second substrates.

The light source module includes a plurality of light sources that generates light to be provided to the liquid crystal display panel to display an image on the liquid crystal display panel. The light sources may include at least one of a cold cathode fluorescent lamp ("CCFL"), an external electrode fluorescent lamp ("EEFL"), a flat fluorescent lamp ("FFL'), and a light emitting diode ("LED").

Generally, the light source generates white light. The color filter passes a specific color among the white light. When the white light passes through the color filter, energy of the white light is reduced.

SUMMARY

Exemplary embodiments of the invention provide a display apparatus with reduced power consumption using light sources having different colors, which are repeatedly turned on and off.

Exemplary embodiments of the invention also provide a method of driving the display apparatus.

In an exemplary embodiment of a display apparatus according to the invention, the display apparatus includes: a display panel including a first subpixel having a first primary color, a second subpixel having a second primary color; and a transparent subpixel; a panel driver which sets grayscale data of the first subpixel, the second subpixel and the transparent subpixel; a light source part which provides light to the display panel, where the light source includes a first light source and a second light source having colors different from each other; and a light source driver which turns on the first light source during a first subframe, turns on the second light source during a second subframe, and turns on the first light source during a third subframe, where a first frame includes the first subframe, the second subframe and the third subframe.

In an exemplary embodiment of a method of driving the display apparatus according to the invention, the method includes setting grayscale data of a first subpixel having a first primary color, a second subpixel having a second primary color and a transparent subpixel, turning on a first light source during a first subframe of a frame, turning on a second light source having a color different from a color of the first light source during a second subframe of the frame, and turning on the first light source during a third subframe of the frame.

In an exemplary embodiment of a display apparatus according to the invention, the display apparatus includes: a display panel including a first subpixel having a first primary color, a second subpixel having a second primary color, and a transparent subpixel; a panel driver which sets grayscale data of the first and second subpixels to be substantially the same as each other during a first subframe of a frame and a second subframe of the frame; a light source part which provides light to the display panel, where the light source includes a first light source and a second light source having colors different from each other; and a light source driver which turns on the first light source during the first subframe and turns on the second light source during the second subframe.

In an exemplary embodiment of a method of driving the display apparatus according to the invention, the method includes setting grayscale data of a transparent subpixel during a first subframe of a frame and a second subframe of the frame, setting same grayscale data of first and second subpixels during the first subframe and the second subframe, where the first subpixel has a first primary color, and the second subpixel has a second primary color, turning on a first light source during the first subframe, and turning on a second light source during the second subframe.

In an exemplary embodiment of a display apparatus according to the invention, the display apparatus includes: a display panel including a first subpixel having a first primary color, a second subpixel having a second primary color, and a transparent subpixel; a panel driver which sets grayscale data of the first subpixel, the second subpixel and the transparent subpixel; a light source part which provides light to the display panel, where the light source includes a first light source and a second light source having colors different from each other; and a light source driver which repeatedly turns on and off at least one of the first and second light sources.

In an exemplary embodiment of a method of driving the display apparatus according to the invention, the method includes setting grayscale data of a first subpixel having a first primary color, a second subpixel having a second primary color and a transparent subpixel, turning on a first light source, turning on a second light source having a color different from a color of the first light source, where at least one of the first and second light sources is repeatedly turned on and off.

According to exemplary embodiments of the display apparatus and the method of driving the display apparatus, the light sources having different colors are repeatedly turned on and off such that power consumption is substantially reduced.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION

Figure 1:
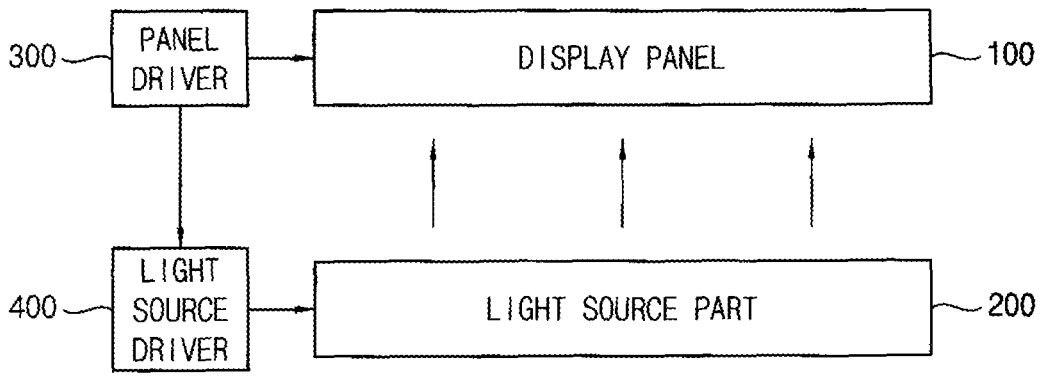
FIG. 1 is a block diagram illustrating an exemplary embodiment of a display apparatus according to the invention.

The invention will be described more fully hereinafter with reference to the accompanying drawings, in which exemplary embodiments of the invention are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in further detail with reference to the accompanying drawings.

Figure 2:
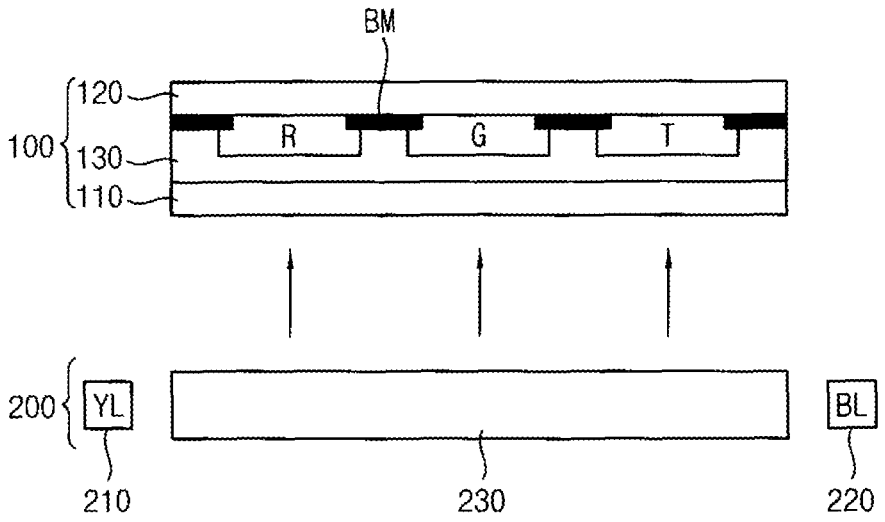
FIG. 2 is a cross-sectional view of an exemplary embodiment of a display panel and a light source part of the display apparatus of FIG. 1.
Figure 3A:
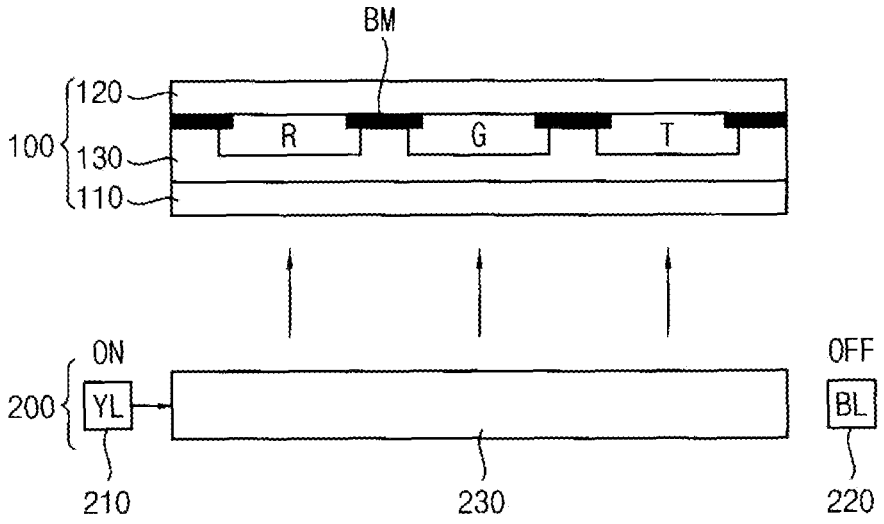
FIG. 3A is a cross-sectional view of an exemplary embodiment of the display panel and the light source part of FIG. 1 in a first subframe.
Figure 3B:
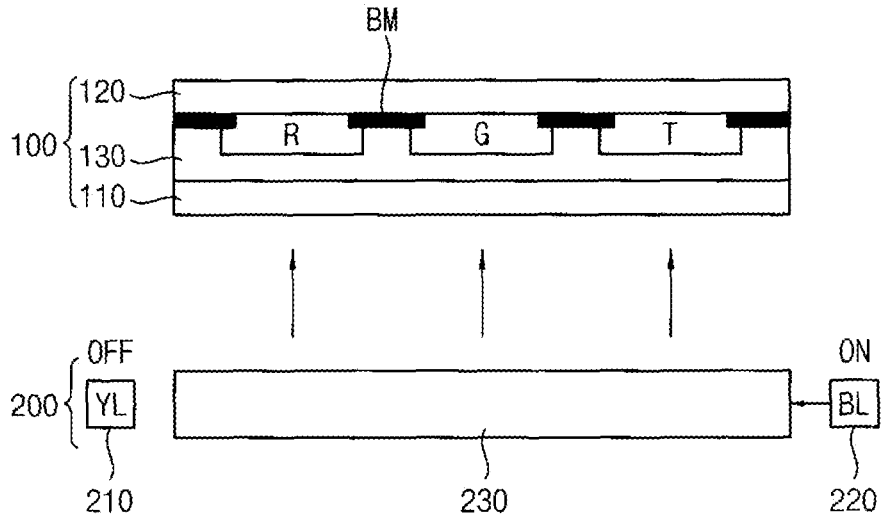
FIG. 3B is a cross-sectional view of an exemplary embodiment of the display panel and the light source part of FIG. 1 in a second subframe.

FIG. 1 is a block diagram illustrating an exemplary embodiment of a display apparatus according to an exemplary embodiment of the invention. FIG. 2 is a cross-sectional view of an exemplary embodiment of a display panel and a light source part of FIG. 1. FIG. 3A is a cross-sectional view of an exemplary embodiment of the display panel and the light source part of FIG. 1 in a first subframe. FIG. 3B is a cross-sectional view of an exemplary embodiment of the display panel and the light source part of FIG. 1 in a second subframe.

Referring to FIGS. 1, 2, 3A and 3B, an exemplary embodiment of the display apparatus includes a display panel 100, a light source part 200, a panel driver 300 and a light source driver 400.

The display panel 100 displays an image. The display panel 100 includes a first substrate 110, a second substrate 120 and a liquid crystal layer 130.

The display panel 100 includes a first subpixel R having a first primary color, a second subpixel G having a second primary color and a transparent subpixel T.

In an exemplary embodiment, as shown in FIG. 2, the first primary color may be red, and the first subpixel R may be a red subpixel. In such an embodiment, the second primary color may be green, and the second subpixel G may be a green subpixel.

The first substrate 110 may be a thin film transistor ("TFT") substrate including a plurality of TFTs. The first substrate 110 may further include a plurality of gate lines extending substantially in a first direction and a plurality of data lines extending substantially in a second direction crossing the first direction. The first substrate 110 may further include a pixel electrode.

The second substrate 120 is disposed opposite to, e.g., faces, the first substrate 110. The second substrate 120 may be a color filter substrate including a plurality of color filters. The second substrate 120 may further include a common electrode.

The first subpixel R may be defined by a red color filter disposed on the second substrate 120. The second subpixel G may be defined by a green color filter disposed on the second substrate 120. The transparent subpixel T may be defined by a transparent color filter disposed on the second substrate 120. In one exemplary embodiment, for example, the transparent color filter may be defined by a substantially empty space, at which no color filter is disposed. A light blocking pattern BM may be disposed between the color filters.

The liquid crystal layer 130 is disposed between the first and second substrates 110 and 120.

In an exemplary embodiment, as shown in FIG. 2, the color filters are disposed on the second substrate 120, but the invention is not limited thereto. In one alternative exemplary embodiment, for example, the color filters may be disposed on the first substrate 110, which is referred to as a color filter on array structure.

The panel driver 300 is connected to the display panel 100 and drives the display panel 100. The panel driver 300 may include a timing controller, a gate driver and a data driver.

The timing controller generates a first control signal that controls a driving timing of the gate driver, and outputs the first control signal to the gate driver. The timing controller generates a second control signal that controls a driving timing of the data driver, and outputs the second control signal to the data driver. The gate driver outputs a gate signal to the gate lines. The data driver outputs a data signal to the data lines.

The panel driver 300 sets grayscale data of the first, second and transparent subpixels R, G and T.

The panel driver 300 generates a light source control signal that controls a driving timing of the light source driver 400, and outputs the light source control signal to the light source driver 400. The panel driver 300 may be substantially synchronized with the light source driver 400.

The light source part 200 includes a first light source 210 and a second light source 220, which have colors different from each other. The light source part 200 may further include a light guide plate 230. The light source part 200 generates light and provides the light to the display panel 100.

The first light source 210 generates light having a mixed color of the first primary color and the second primary color. In an exemplary embodiment, the first primary color may be red, the second primary color may be green, and the mixed color of the first and second primary colors may be yellow.

The second light source 220 generates light having a third primary color. The third primary color may be blue.

When the first, second and third primary colors are mixed with one another, the mixed color is white. In an exemplary embodiment, the first, second and third primary colors may be red, green and blue, respectively, but the invention is not limited thereto.

In an exemplary embodiment, the first light source 210 may be a light emitting diode ("LED") chip which emits yellow light YL. The second light source 220 may be a LED chip which emits blue light BL. In an alternative exemplary embodiment, the first light source 210 may include a blue LED chip and a yellow phosphor.

The light guide plate 230 guides the light from the first and second light sources 210 and 220 to the display panel 100

In an exemplary embodiment, as shown in FIG. 2, the first light source 210 may be disposed in a first side of the light guide plate 230, and the second light source 220 may be disposed in a second side of the light guide plate 230 opposite to the first side of the light guide plate 230.

In an alternative exemplary embodiment, the first and second light sources 210 and 220 may be disposed in a same side, e.g., in the first or second side, of the light guide plate 230.

In one exemplary embodiment, for example, the first light source 210 and the second light source 220 may be provided in the form of a double layer in the first side of the light guide plate 230. In one exemplary embodiment, for example, the first light source 210 is disposed on a first layer in the first side of the light guide plate 230 and the second light source 210 is disposed on a second layer on the first layer in the first side of the light guide plate 230. In one exemplary embodiment, for example, the first and second light sources 210 and 220 may be alternately disposed on the same layer. In one exemplary embodiment, for example, the first and second light sources 210 and 220 may be alternately disposed on a first layer, and the first and second light sources 210 and 220 may be alternately disposed on a second layer. In such an embodiment, the second light source 220 on the second layer may correspond to the first light source 210 on the first layer and the first light source 210 on the second layer may correspond to the second light source 220 on the first layer.

In an alternative exemplary embodiment, the first light source 210 and the second light source 220 may be provided in the form of a package. The package may include a LED and a phosphor. In one exemplary embodiment, for example, the LED in the package may have the third primary color. The phosphor in the package may have the mixed color.

In one exemplary embodiment, for example, the package may include a side wall that divides the package into a first receiving area and a second receiving area. The first light source 210 may be defined as a first LED of the third primary color on a bottom surface of the first receiving area and the phosphor of the mixed color filling the first receiving area. The second light source 220 may be defined as a second LED of the third primary color. The second receiving area may be filled with a transparent resin.

In an exemplary embodiment, as shown in FIG. 2, the light source part 200 is an edge type light source part including the light guide plate 230 and the first and second light sources 210 and 220 disposed side portions of the light guide plate 230, but the invention is not limited thereto. In an alternative exemplary embodiment, the light source part 200 may be a direct type light source part including a plurality of light sources disposed under the display panel 100 and corresponding to an entire area of the display panel 100.

In an exemplary embodiment, as shown in FIG. 2, the display apparatus is the liquid crystal display apparatus including the liquid crystal layer 130, but the invention is not limited thereto. In an alternative exemplary embodiment, the display apparatus may be organic light emitting diode ("OLED") display apparatus including the OLEDs.

The light source driver 400 is connected to the light source part 200. The light source driver 400 drives the light source part 200. The light source driver 400 repeatedly turns on and off at least one of the first and second light sources 210 and 220.

In an exemplary embodiment, as shown in FIGS. 3A and 3B, the light source driver 400 may alternately turn on the first and second light sources 210 and 220. In one exemplary embodiment, for example, the first light source 210 is turned on during a first subframe, and the second light source 220 is turned off during the first subframe. In such an embodiment, the first light source 210 is turned off during a second subframe, and the second light source 220 is turned on during the second subframe.

An exemplary embodiment of a method of driving the light source part 300 by the light source driver 400 will be described in detail referring to FIGS. 4 to 7.

In an exemplary embodiment, duration of the first subframe may be substantially equal to duration of the second frame. In an alternative exemplary embodiment, the duration of the first subframe may be different from the duration of the second frame.

The panel driver 300 operates subpixel rendering to set grayscale data of the first subpixel R, the second subpixel G and the transparent subpixel T.

Figure 4:
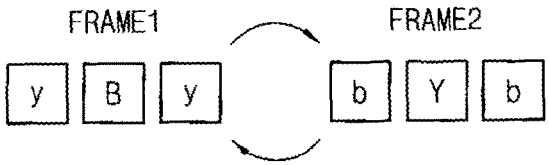
FIGS. 4 to 6 are conceptual diagrams illustrating an exemplary embodiment of a method of driving the display apparatus of FIG. 1.
Figure 5:
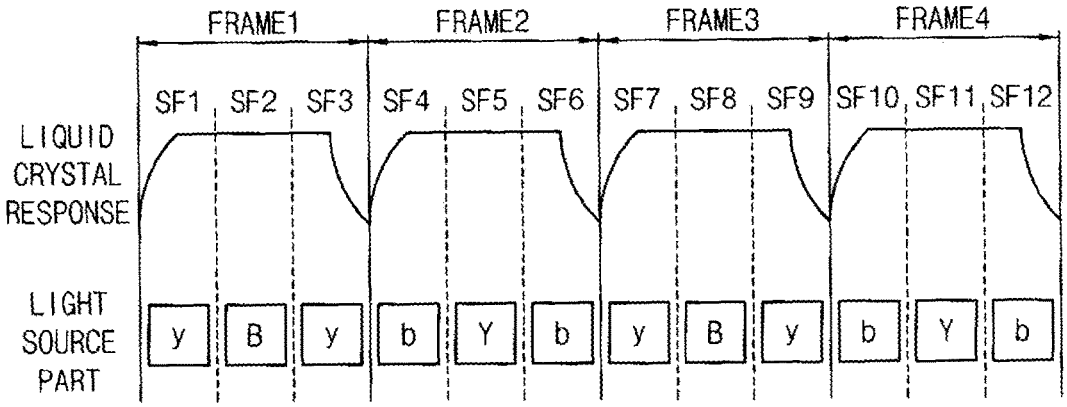
Figure 6:
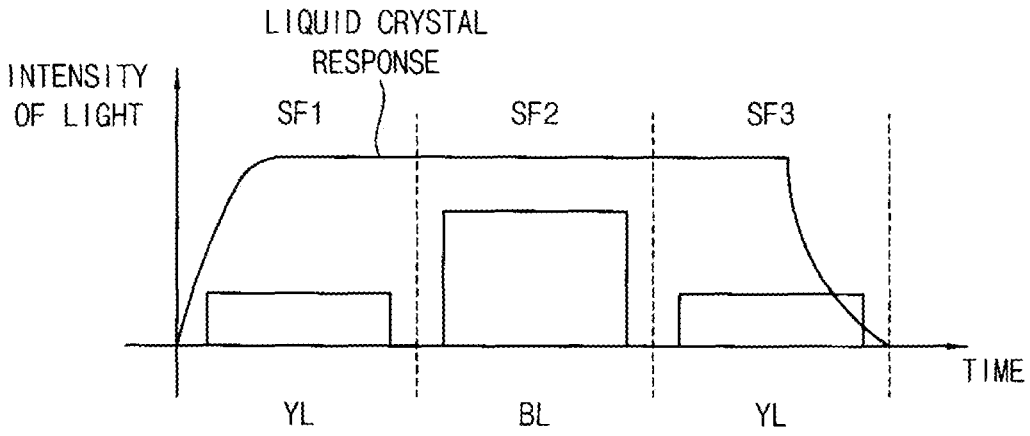

FIGS. 4 to 6 are conceptual diagrams illustrating an exemplary embodiment of a method of driving the display apparatus of FIG. 1.

Referring to FIGS. 1 to 6, a frame, e.g., a unit frame corresponding to a single input image datum, is divided into three subframes. A first frame FRAME1 includes a first subframe SF1, a second subframe SF2 and a third subframe SF3. A second frame FRAME2 includes a fourth subframe SF4, a fifth subframe SF5 and a sixth subframe SF6. A third frame FRAME3 includes a seventh subframe SF7, an eighth subframe SF8 and a ninth subframe SF9. A fourth frame FRAME4 includes a tenth subframe SF10, an eleventh subframe SF11 and a twelfth subframe SF12.

In an exemplary embodiment, when the input image data are inputted in about 60 hertz (Hz), the display panel 100, which is driven into three subframes by a time dividing method, displays an image in about 180 Hz. The light source driver 400 alternately turns on the first and second light sources 210 and 220 in the unit of two subframes such that an alternate turn on frequency of the first and second light sources 210 and 220 is 120 Hz.

In an exemplary embodiment, the light source part 200 is driven in the unit of two frames. In the first frame FRAME1 and the third frame FRAME3, the first light source 210, the second light source 220 and the first light source 210 are sequentially turned on corresponding to each subframe. In such an embodiment, in the second frame FRAME2 and the fourth frame FRAME4, the second light source 220, the first light source 210 and the second light source 220 are sequentially turned on corresponding to each subframe.

The light source driver 400 turns on the first light source 210 during the first subframe SF1. The light source driver 400 turns on the second light source 220 during the second subframe SF2. The light source driver 400 turns on the first light source 210 during the third subframe SF3. The light source driver 400 turns on the second light source 220 during the fourth subframe SF4. The light source driver 400 turns on the first light source 210 during the fifth subframe SF5. The light source driver 400 turns on the second light source 220 during the sixth subframe SF6.

The light source driver 400 controls the first light source 210 to emit light of a first intensity y during the first and third subframes SF1 and SF3, and to emit light of a second intensity Y greater than the first intensity y during the fifth subframe SF5 in response to the same grayscale data.

The light source driver 400 controls the second light source 220 to emit light of a third intensity b during the fourth and sixth subframes SF4 and SF6, and to emit light of a fourth intensity B greater than the third intensity b during the second subframe SF2 in response to the same grayscale data.

In one exemplary embodiment, for example, the first intensity y may be half of the second intensity Y corresponding to the same grayscale data. The third intensity b may be about half of the fourth intensity B corresponding to the same grayscale data. In such an embodiment, when the same grayscale data are applied during the first frame FRAME1 and the second frame FRAME2, a total intensity of the first light source 210 during the first frame FRAME1 may be twice the first intensity y (e.g., 2y) and a total intensity of the first light source 210 during the second frame FRAME2 is the second intensity Y. When the first intensity y is about half of the second intensity Y corresponding to the same grayscale data, the first light source 210 has substantially the same intensity during the first frame FRAME1 and the second frame FRAME2 corresponding to the same grayscale data.

A method of driving the light source part 200 during the seventh to twelfth subframes SF7 to SF12 is substantially the same as the method of driving the light source part 200 during the first to sixth subframes SF1 to SF6.

A liquid crystal response of the transparent subpixel T and the intensities of the first and second light sources 210 and 220 for each subframe are illustrated in FIGS. 5 and 6. For convenience of description, an exemplary embodiment where the transparent subpixel T has substantially the same data voltage during the first to third subframes SF1 to SF3 are shown in FIGS. 5 and 6.

During the first subframe SF1, liquid crystal molecules corresponding to the transparent subpixel T are gradually converted into a transmitting state, in which the liquid crystal molecules transmit light. During the second subframe SF2, the liquid crystal molecules corresponding to the transparent subpixel T maintains the transmitting state. During the third subframe SF3, the liquid crystal molecules corresponding to the transparent subpixel T are gradually converted from the transmitting state into a blocking state, in which the liquid crystal molecules block light.

In an exemplary embodiment, during the first subframe SF1 and the third subframe SF3, when the state of the liquid crystal molecule is changed, the first light source 210 has a relatively low intensity, e.g., the first intensity y, such that a decrease of the luminance due to a delay of the liquid crystal response speed is effectively compensated during the first frame FRAME1.

In an exemplary embodiment, during the third subframe SF3 and the fourth subframe SF4 which correspond to a boundary between the first frame FRAME1 and the second frame FRAME2, each of the first light source 210 and the second light source 220 emit light of a relatively low intensity, e.g., the first intensity y or the third intensity b, respectively, such that a color breakup is substantially reduced or effectively prevented.

Figure 7:
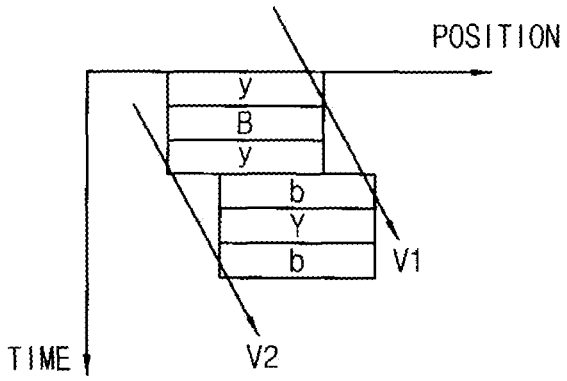
FIGS. 7 and 8 are conceptual diagrams illustrating an exemplary embodiment of an image displayed on the display panel of FIG. 1 based on the method of driving the display apparatus of FIGS. 4 to 6.
Figure 8:
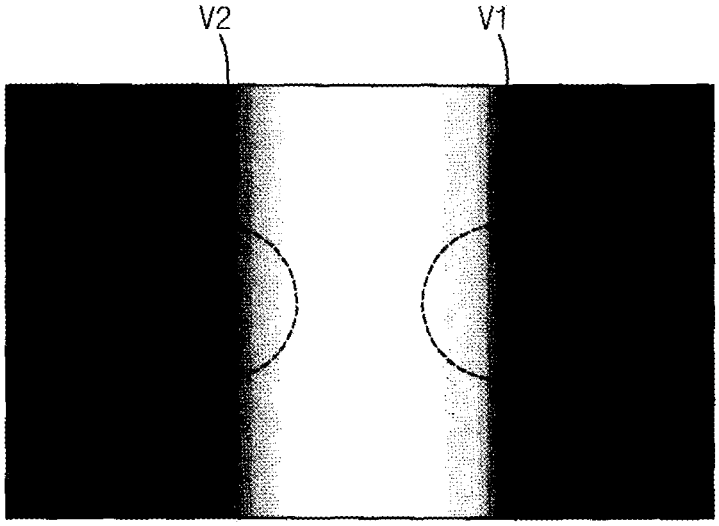

FIGS. 7 and 8 are conceptual diagrams illustrating an exemplary embodiment of an image displayed on the display panel of FIG. 1 based on the method of driving the display apparatus of FIGS. 4 to 6.

FIG. 7 shows an exemplary embodiment in which an image of white rectangle is moving in a horizontal direction on the display panel 100.

Referring to FIG. 7, an upper rectangle shows the image of the white rectangle during the first frame FRAME1, and a lower rectangle shows the image of the white rectangle during the second frame FRAME2.

During the first frame FRAME1, the first and second light sources 210 and 220 sequentially emit the light of the first intensity y, the fourth intensity B and the first intensity y. During the second frame FRAME2 when the image is displaced in a horizontal direction from the image of the first frame FRAME1, the first and second light sources 210 and 220 sequentially emit the light of the third intensity b, the second intensity Y and the third intensity b.

Referring to FIGS. 7 and 8, a viewpoint of a viewer moves according to a movement of the image of the white rectangle.

When the viewpoint of the viewer corresponds to a first viewpoint V1, a yellow color y and a blue color b, which are complimentary from each other, are shown to the viewer such that the viewer recognizes an image of an achromatic color. Thus, the color breakup is effectively prevented. In the first viewpoint V1, each of the first light source 210 and the second light source 220 emits light of the relatively low intensity, e.g., the first intensity y or the third intensity b, such that the movement of the image may be recognized substantially smoothly.

When the viewpoint of the viewer corresponds to a second viewpoint V2, the yellow color y and the blue color b, which are complimentary from each other, are shown to the viewer such that the viewer recognizes an image of an achromatic color. Thus, the color breakup is effectively prevented. In the second viewpoint V2, each of the first light source 210 and the second light source 220 has the relatively low intensity, e.g., the first intensity y or the third intensity b, such that the movement of the image may be recognized substantially smoothly.

According to an exemplary embodiment, as described above, the display panel 100 includes red, green and transparent subpixels R, G and T, and the light source part 200 includes yellow and blue light sources YL and BL, which are repeatedly turned on and off, such that power consumption of the display apparatus substantially decreases. In such an embodiment, the color breakup is effectively prevented such that display quality of the display apparatus is substantially improved.

Figure 9:
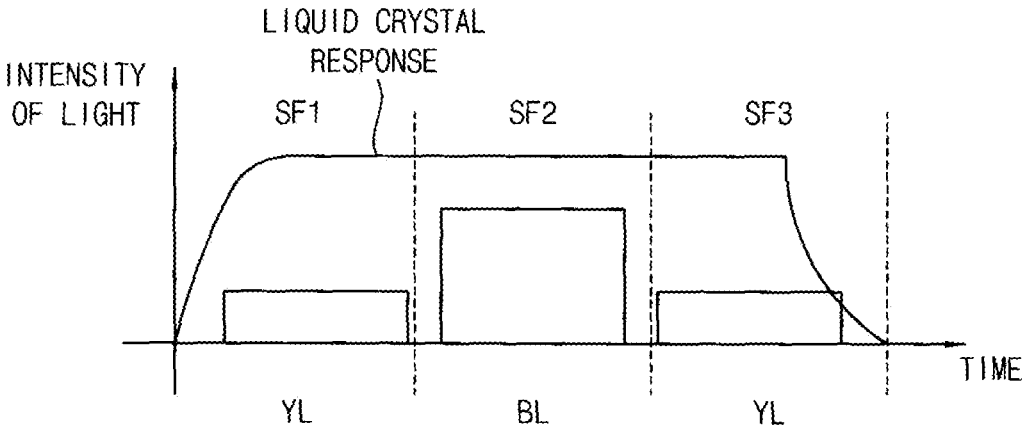
FIG. 9 is a conceptual diagram illustrating an alternative exemplary embodiment of a method of driving the display apparatus of FIG. 1 according to the invention.

FIG. 9 is a conceptual diagram illustrating an alternative exemplary embodiment of a method of driving the display apparatus of FIG. 1 according to the invention.

The method of driving the display apparatus shown in FIG. 9 is substantially the same as the method of driving the display apparatus shown in FIGS. 4 to 8 except for a turn-on timing of the first light source 210 during the first and third subframes SF1 and SF3. The same or like elements shown in FIG. 9 have been labeled with the same reference characters as used above to describe the exemplary embodiments of the method of driving the display apparatus shown in FIGS. 4 to 8, and any repetitive detailed description thereof will hereinafter be omitted or simplified.

A liquid crystal response of the transparent subpixel T and the intensities of the first and second light sources 210 and 220 for each subframe are illustrated in FIGS. 5 and 9. For convenience of description, an exemplary embodiment, in which the transparent subpixel T receives the same data voltage during the first to third subframes SF1 to SF3 as in FIGS. 5 and 6, will be described.

Referring to FIGS. 5 and 9, during the first subframe SF1, liquid crystal molecules corresponding to the transparent subpixel T are gradually converted into the transmitting state. During the second subframe SF2, the liquid crystal molecules corresponding to the transparent subpixel T maintains the transmitting state. During the third subframe SF3, the liquid crystal molecules corresponding to the transparent subpixel T are gradually converted from the transmitting state into the blocking state.

In an exemplary embodiment, during the first subframe SF1 and the third subframe SF3, when the state of the liquid crystal molecule is changed, the first light source 210 emits light of the relatively low intensity, e.g., the first intensity y, such that a decrease of the luminance due to a delay of the liquid crystal response speed is substantially reduced during the first frame FRAME1.

In an exemplary embodiment, a turn-on timing of the first light source 210 in the first subframe SF1 may be delayed compared to a turn-on timing of the second light source 220 in the second subframe SF2. The turn-on timing of the first light source 210 in the first subframe SF1 is shifted toward the second subframe SF2. A duty ratio of the first light source 210 in the first subframe SF1 may be substantially the same as a duty ratio of the second light source 220 in the second subframe SF2.

In an exemplary embodiment, a turn-on timing of the first light source 210 in the third subframe SF3 may be shifted forward compared to the turn-on timing of the second light source 220 in the second subframe SF2. The turn-on timing of the first light source 210 in the third subframe SF3 is shifted toward the second subframe SF2. A duty ratio of the first light source 210 in the third subframe SF3 may be substantially the same as a duty ratio of the second light source 220 in the second subframe SF2.

According to an exemplary embodiment, during the first subframe SF1 when the state of the liquid crystal molecules are changed, the turn-on timing of the first light source 210 is relatively delayed and during the third subframe SF3 when the state of the liquid crystal molecules are changed, the turn-on timing of the first light source 210 is relatively shifted forward such that a decrease of the luminance due to a delay of the liquid crystal response speed is substantially reduced.

Figure 10:
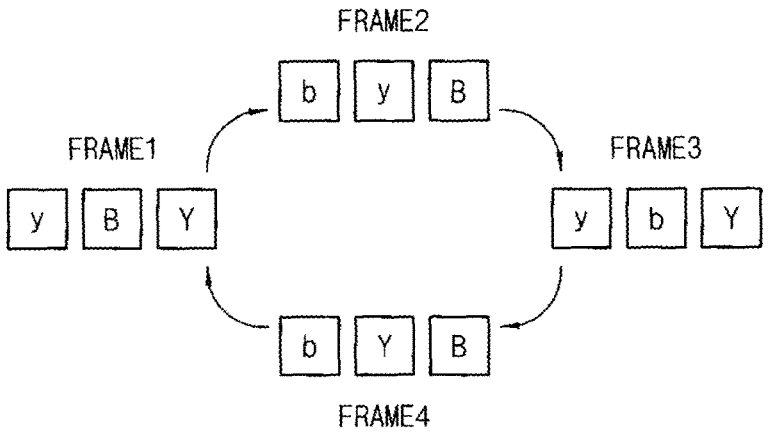
FIGS. 10 and 11 are conceptual diagrams illustrating another alternative exemplary embodiment of a method of driving the display apparatus of FIG. 1 according to the invention.
Figure 11:
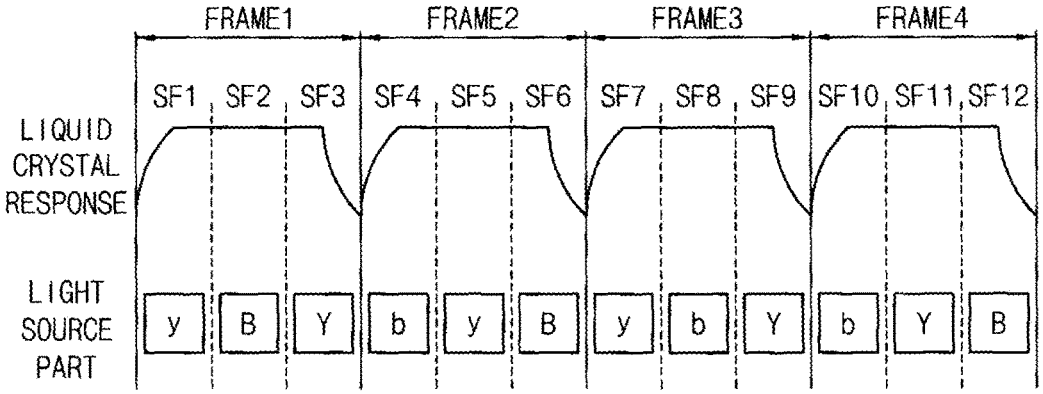

FIGS. 10 and 11 are conceptual diagrams illustrating another alternative exemplary embodiment of a method of driving the display apparatus of FIG. 1 according to the invention.

The method of driving the display apparatus shown in FIGS. 10 and 11 is substantially the same as the method of driving the display apparatus in FIGS. 4 to 8 except that the light source part 200 is driven in the unit of four frames. The same or like elements shown in FIGS. 10 and 11 have been labeled with the same reference characters as used above to describe the exemplary embodiments of the method of driving the display apparatus shown in FIGS. 4 to 8, and any repetitive detailed description thereof will hereinafter be omitted or simplified.

Referring to FIGS. 1 to 3B, 10 and 11, a frame, e.g., a unit frame corresponding to a single input image datum, is divided into three subframes. A first frame FRAME1 includes a first subframe SF1, a second subframe SF2 and a third subframe SF3. A second frame FRAME2 includes a fourth subframe SF4, a fifth subframe SF5 and a sixth subframe SF6. A third frame FRAME3 includes a seventh subframe SF7, an eighth subframe SF8 and a ninth subframe SF9. A fourth frame FRAME4 includes a tenth subframe SF10, an eleventh subframe SF11 and a twelfth subframe SF12.

In an exemplary embodiment, the light source part 200 is driven in the unit of four frames. In the first frame FRAME1 and the third frame FRAME3, the first light source 210, the second light source 220 and the first light source 210 are sequentially turned on corresponding to each subframe. In such an embodiment, in the second frame FRAME2 and the fourth frame FRAME4, the second light source 220, the first light source 210 and the second light source 220 are sequentially turned on corresponding to each subframe.

The light source driver 400 turns on the first light source 210 during the first subframe SF1. The light source driver 400 turns on the second light source 220 during the second subframe SF2. The light source driver 400 turns on the first light source 210 during the third subframe SF3. The light source driver 400 turns on the second light source 220 during the fourth subframe SF4. The light source driver 400 turns on the first light source 210 during the fifth subframe SF5. The light source driver 400 turns on the second light source 220 during the sixth subframe SF6. The light source driver 400 turns on the first light source 210 during the seventh subframe SF7. The light source driver 400 turns on the second light source 220 during the eighth subframe SF8. The light source driver 400 turns on the first light source 210 during the ninth subframe SF9. The light source driver 400 turns on the second light source 220 during the tenth subframe SF10. The light source driver 400 turns on first light source 210 during the eleventh subframe SF11. The light source driver 400 turns on the second light source 220 during the twelfth subframe SF12.

The light source driver 400 controls the first light source 210 to emit light of the first intensity y during the first, fifth and seventh subframes SF1, SF5 and SF7, and to emit light of the second intensity Y greater than the first intensity y during the third, ninth and eleventh subframes SF3, SF9 and SF11 in response to the same grayscale data.

The light source driver 400 controls the second light source 220 to emit light of the third intensity b during the fourth, eighth and tenth subframes SF4, SF8 and SF10, and to emit light of the fourth intensity B greater than the third intensity b during the second, sixth and twelfth subframes SF2, SF6 and SF12 in response to the same grayscale data.

In one exemplary embodiment, for example, the first intensity y may be one third of the second intensity Y corresponding to the same grayscale data. The third intensity b may be one third of the fourth intensity B corresponding to the same grayscale data.

In an exemplary embodiment, during one of the third and fourth subframes SF3 and SF4, during one of the sixth and seventh subframes SF6 and SF7, during one of the ninth and tenth subframes SF9 and SF10 and during one of the twelfth and thirteenth subframes SF12 and SF13, which correspond to boundaries between the first to fourth frames FRAME1 to FRAME4, the first light source 210 or the second light source 220 emits light of the relatively low intensity, e.g., the first intensity y or the third intensity b, such that the color breakup is substantially reduced.

Figure 12:
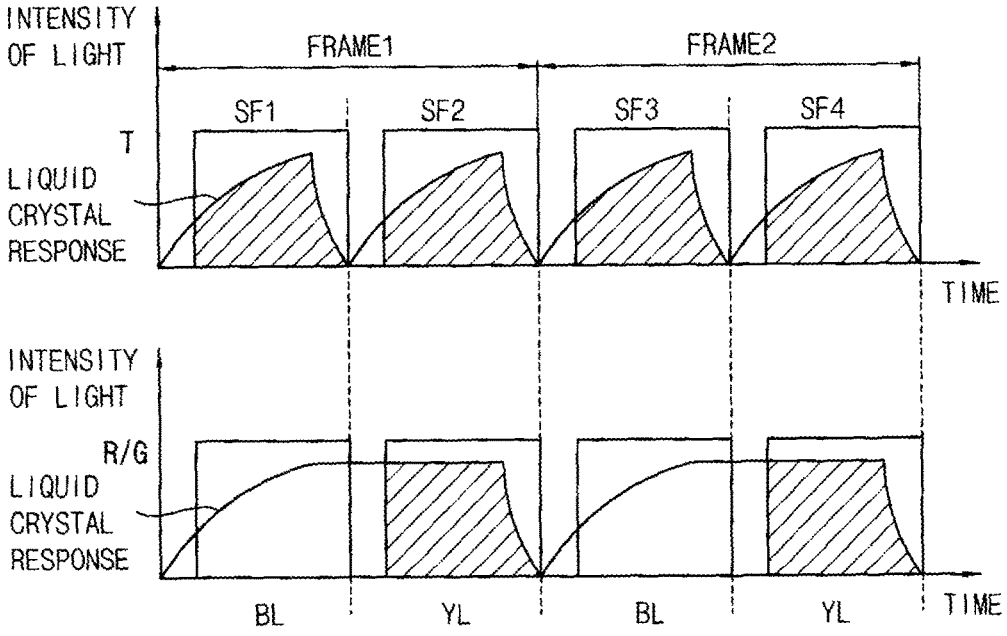
FIG. 12 is a conceptual diagram illustrating another alternative exemplary embodiment of a method of driving the display apparatus of FIG. 1 according to the invention.

FIG. 12 is a conceptual diagram illustrating another alternative exemplary embodiment of a method of driving the display apparatus of FIG. 1 according to the invention.

The method of driving the display apparatus shown in FIG. 12 is substantially the same as the method of driving the display apparatus in FIGS. 4 to 8 except for a method of driving the display panel 100 and a method of driving the light source part. The same or like elements shown in FIG. 12 have been labeled with the same reference characters as used above to describe the exemplary embodiments of the method of driving the display apparatus shown in FIGS. 4 to 8, and any repetitive detailed description thereof will hereinafter be omitted or simplified.

In FIG. 12, an exemplary embodiment of a method of driving the transparent sub pixel T, and driving the first and second subpixels R and G is shown.

Referring to FIGS. 1 to 3B and 12, the display panel 100 displays red and green using the first and second subpixels R and G and yellow light of the first light source 210, which is mixed light of red light and green light. The display panel 100 displays blue using blue light of the second light source 220.

In an exemplary embodiment, a frame, e.g., a unit frame corresponding to a single input image datum, is divided into two subframes. A first frame FRAME1 includes a first subframe SF1 and a second subframe SF2. A second frame FRAME2 includes a third subframe SF3 and a fourth subframe SF4.

In an exemplary embodiment, when the input image data are inputted in about 60 Hz, the display panel 100, which is driven into two subframes by a time dividing method, displays an image in about 120 Hz. The light source driver 400 alternately turns on the first and second light sources 210 and 220 in the unit of two subframes such that an alternate turn-on frequency of the first and second light sources 210 and 220 is about 120 Hz.

In an exemplary embodiment, during the first and third subframes SF1 and SF3, the second light source 220 that emits the blue light is turned on. During the second and fourth subframes SF2 and SF4, the first light source 210 that emits the yellow light is turned on.

If the transparent subpixel T is driven substantially the same as the first and second subpixels R and G, the display panel 100 may not display a full grayscale of the red color and a full grayscale of the green color. The display panel 100 may display about 50% of the full grayscale of the red color and about 50% of the full grayscale of the green color. When a level of the full grayscale is 100 grayscale level and the 100 grayscale level (full grayscale) of white is displayed, the second light source 220 generates blue light corresponding to 100 grayscale level and the transparent subpixel T substantially entirely transmits the blue light from the second light source 220 during the first subframe SF1 such that 100 grayscale level of the blue color is displayed. During the second subframe SF2, the first light source 210 generates yellow light corresponding to 50 grayscale level, the first subpixel R and the second subpixel G substantially entirely transmit the yellow light from the first light source 210 such that 100 grayscale level of the red color and 100 grayscale level of the green color are displayed and the transparent subpixel T substantially entirely transmit the yellow light from the first light source 210 such that 100 grayscale level of the yellow color is displayed.

In the above method of driving the display panel 100, 100 grayscale level of the red color is generated by combining 50 grayscale level of the first subpixel R and a red composition of 50 grayscale level of the yellow color such that the display panel 100 may not display the 100 grayscale level of the red color.

In an exemplary embodiment of the method of driving the display panel 100, the panel driver 300 sets substantially the same grayscale data of the first and second subpixels R and G during the first and second subframes SF1 and SF2.

In such an embodiment, the panel driver 300 sets grayscale data of the first and second subpixels R and G corresponding to the grayscale data for the second subframe SF2 during the first and second subframes SF1 and SF2.

During the first subframe SF1, the blue light BL is turned on, such that the first and second subpixels R and G do not transmit the light although liquid crystal molecules corresponding to the first and second subpixels R and G is in the transmitting state. Thus, the image displayed during the first subframe SF1 is not changed when the grayscale data of the first and second subpixels R and G is precharged during the first subframe SF1.

In an exemplary embodiment, the grayscale data corresponding to the second subframe SF2 are precharged to the first and second subpixels R and G during the first subframe SF1 such that a slow liquid crystal response is effectively compensated, and a luminance of the first and second subpixels R and G during the second subframe SF2 is thereby substantially improved.

In such an embodiment, the panel driver 300 sets first grayscale data of the transparent subpixel T corresponding to the first subframe SF1 during the first subframe SF1 and second grayscale data of the transparent subpixel T corresponding to the second subframe SF2 during the second subframe SF2.

In FIG. 12, an overlapping area of the liquid crystal response curve and the intensity of the light is substantially proportional to a luminance of the subpixel in the subframe.

During the second subframe SF2, the light having substantially the same intensity is provided to the transparent subpixel T and the first subpixel R, and the liquid crystal molecules corresponding to the transparent subpixel T and the liquid crystal molecules corresponding to the first subpixel R are controlled to have substantially the same light transmittance. The first subpixel R is precharged during the first subframe SF1 such that the first subpixel R may display a luminance greater than a luminance of the transparent subpixel T.

In one exemplary embodiment, for example, when the light having the same intensity is provided to the transparent subpixel T and the first subpixel R, and the liquid crystal molecules corresponding to the transparent subpixel T and the liquid crystal molecules corresponding to the first subpixel R are controlled to have substantially the same light transmittance during the second subframe SF2, the luminance of the first subpixel R may be about twice the luminance of the transparent subpixel T.

In an exemplary embodiment, when the light transmittance of the liquid crystal molecules corresponding to the first subpixel R is set to maximum and the intensity of the yellow light is set to maximum (e.g., corresponding to 50 grayscale level), the red subpixel may display 100 grayscale level of the red color.

In the same way, when the light transmittance of the liquid crystal molecules corresponding to the second subpixel G is set to maximum and the intensity of the yellow light is set to maximum (corresponding to 50 grayscale level), the green subpixel may display 100 grayscale level of the green color.

According to an exemplary embodiment, as described above, the first and second subpixels R and G are precharged during the first subframe SF1 such that the display panel 100 effectively displays a predetermined grayscale, and the display quality is thereby substantially improved.

Figure 13:
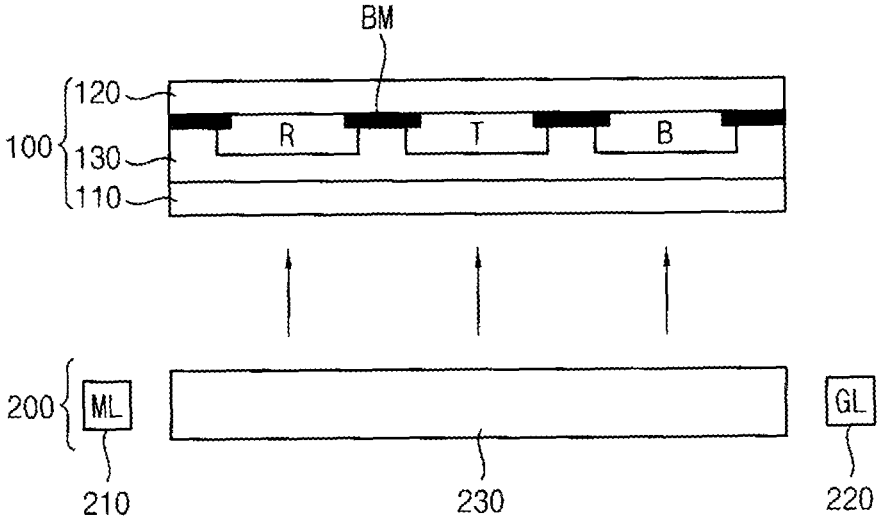
FIG. 13 is a cross-sectional view of a display panel and a light source part of an alternative exemplary embodiment of a display apparatus according to the invention.
Figure 14:
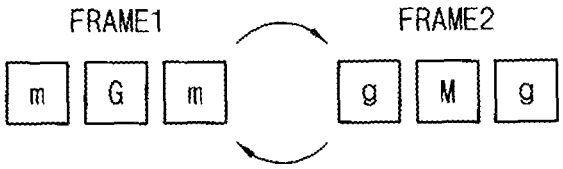
FIG. 14 is a conceptual diagram illustrating an exemplary embodiment of a method of driving the display apparatus of FIG. 13.

FIG. 13 is a cross-sectional view of a display panel and a light source part of an alternative exemplary embodiment of a display apparatus according to the invention. FIG. 14 is a conceptual diagram illustrating an exemplary embodiment of a method of driving the display apparatus of FIG. 13.

The display apparatus and the method of driving the display apparatus shown in FIGS. 13 and 14 are substantially the same as the display apparatus and the method of driving the display apparatus shown in FIGS. 1 to 8 except that a first subpixel is a red subpixel, a second subpixel is a blue subpixel, a first light source is a magenta light source and a second light source is a green light source. The same or like elements shown in FIGS. 13 and 14 have been labeled with the same reference characters as used above to describe the exemplary embodiments of the display apparatus and the method of driving the display apparatus shown in FIGS. 1 to 8, and any repetitive detailed description thereof will hereinafter be omitted or simplified.

Referring to FIGS. 1 and 13, an exemplary embodiment of the display apparatus includes a display panel 100, a light source part 200, a panel driver 300 and a light source driver 400.

The display panel 100 includes a first subpixel R having a first primary color, a second subpixel B having a second primary color and a transparent subpixel T.

In an exemplary embodiment, as shown in FIG. 13, the first primary color may be red, and the first subpixel R may be a red subpixel. In such an embodiment, the second primary color may be blue, and the second subpixel B may be a blue subpixel.

The first subpixel R may be defined by a red color filter disposed on the second substrate 120. The second subpixel B may be defined by a blue color filter disposed on the second substrate 120. The transparent subpixel T may be defined by a transparent color filter disposed on the second substrate 120. In one exemplary embodiment, for example, the transparent color filter may be defined by a substantially empty space, at which no color filter is disposed. A light blocking pattern BM may be disposed between the color filters.

The panel driver 300 sets grayscale data of the first, second and transparent subpixels R, B and T.

The light source part 200 includes a first light source 210 and a second light source 220. The light source part 200 may further include a light guide plate 230. The light source part 200 generates light and provides the light to the display panel 100.

The first light source 210 generates light having a mixed color of the first primary color and the second primary color. In an exemplary embodiment, as shown in FIG. 13, the first primary color is red, the second primary color is blue, and the mixed color of the first and second primary colors is magenta.

The second light source 220 generates light having a third primary color. The third primary color may be green.

The light source driver 400 is connected to the light source part 200. The light source driver 400 drives the light source part 200. In an exemplary embodiment, the light source driver 400 may alternately turn on the first and second light sources 210 and 220. In one exemplary embodiment, for example, during a first subframe, the first light source 210 is turned on and the second light source 220 is turned off. In such an embodiment, during a second subframe, the first light source 210 is turned off and the second light source 220 is turned on.

Referring to FIGS. 5, 13 and 14, a frame, e.g., a unit frame corresponding to a single input image datum, is divided into three subframes.

The light source driver 400 turns on the first light source 210 during the first subframe SF1. The light source driver 400 turns on the second light source 220 during the second subframe SF2. The light source driver 400 turns on the first light source 210 during the third subframe SF3. The light source driver 400 turns on the second light source 220 during the fourth subframe SF4. The light source driver 400 turns on the first light source 210 during the fifth subframe SF5. The light source driver 400 turns on the second light source 220 during the sixth subframe SF6.

The light source driver 400 controls the first light source 210 to emit light of a first intensity m during the first and third subframes SF1 and SF3, and to emit light of a second intensity M greater than the first intensity m during the fifth subframe SF5 in response to the same grayscale data.

The light source driver 400 controls the second light source 220 to emit light of a third intensity g during the fourth and sixth subframes SF4 and SF6, and to emit light of a fourth intensity G greater than the third intensity g during the second subframe SF2 in response to the same grayscale data.

According to an exemplary embodiment, as shown in FIGS. 13 and 14, the display panel 100 includes red, blue and transparent subpixels R, B and T, and the light source part 200 includes magenta and green light sources ML and GL, which are repeatedly turned on and off, such that the power consumption of the display apparatus substantially decreases. In such an embodiment, the color breakup is effectively prevented, and the display quality of the display apparatus is thereby substantially improved.

Figure 15:
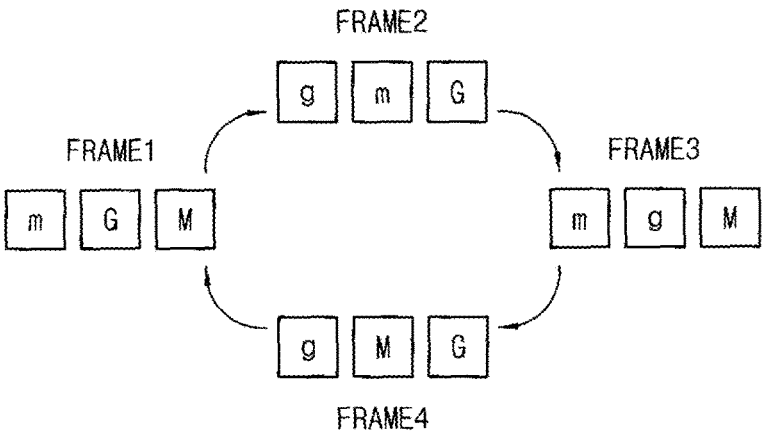
FIG. 15 is a conceptual diagram illustrating an alternative exemplary embodiment of a method of driving the display apparatus of FIG. 13 according to an the invention.

FIG. 15 is a conceptual diagram illustrating an alternative exemplary embodiment of a method of driving the display apparatus of FIG. 13 according to the invention.

The method of driving the display apparatus shown in FIG. 15 is substantially the same as the method of driving the display apparatus in FIG. 14 except that the light source part 200 is driven in the unit of four frames. The method of driving the display apparatus shown in FIG. 15 is substantially the same as the method of driving the display apparatus in FIGS. 10 and 11 except that the display panel 100 includes red, blue and transparent subpixels R, B and T, and the light source part 200 includes magenta and green light sources ML and GL. The same or like elements shown in FIG. 15 have been labeled with the same reference characters as used above to describe the exemplary embodiments of the method of driving the display apparatus shown in FIGS. 10, 11 and 14, and any repetitive detailed description thereof will hereinafter be omitted or simplified.

Referring to FIGS. 11, 13 and 15, the light source driver 400 turns on the first light source 210 during the first subframe SF1. The light source driver 400 turns on the second light source 220 during the second subframe SF2. The light source driver 400 turns on the first light source 210 during the third subframe SF3. The light source driver 400 turns on the second light source 220 during the fourth subframe SF4. The light source driver 400 turns on the first light source 210 during the fifth subframe SF5. The light source driver 400 turns on the second light source 220 during the sixth subframe SF6. The light source driver 400 turns on the first light source 210 during the seventh subframe SF7. The light source driver 400 turns on the second light source 220 during the eighth subframe SF8. The light source driver 400 turns on the first light source 210 during the ninth subframe SF9. The light source driver 400 turns on the second light source 220 during the tenth subframe SF10. The light source driver 400 turns on first light source 210 during the eleventh subframe SF11. The light source driver 400 turns on the second light source 220 during the twelfth subframe SF12.

The light source driver 400 controls the first light source 210 to emit light of a first intensity m during the first, fifth and seventh subframes SF1, SF5 and SF7, and to emit light of a second intensity M greater than the first intensity m during the third, ninth and eleventh subframes SF3, SF9 and SF11 in response to the same grayscale data.

The light source driver 400 controls the second light source 220 to emit light of a third intensity g during the fourth, eighth and tenth subframes SF4, SF8 and SF10, and to emit light of a fourth intensity G greater than the third intensity g during the second, sixth and twelfth subframes SF2, SF6 and SF12 in response to the same grayscale data.

In the exemplary embodiment, during one of the third and fourth subframes SF3 and SF4, during one of the sixth and seventh subframes SF6 and SF7, during one of the ninth and tenth subframes SF9 and SF10 and during one of the twelfth and thirteenth subframes SF12 and SF13, which correspond to boundaries between the first to fourth frames FRAME1 to FRAME4, the first light source 210 or the second light source 220 emits light of a relatively low intensity, e.g., the first intensity m or the third intensity g, such that the color breakup is substantially reduced.

Figure 16:
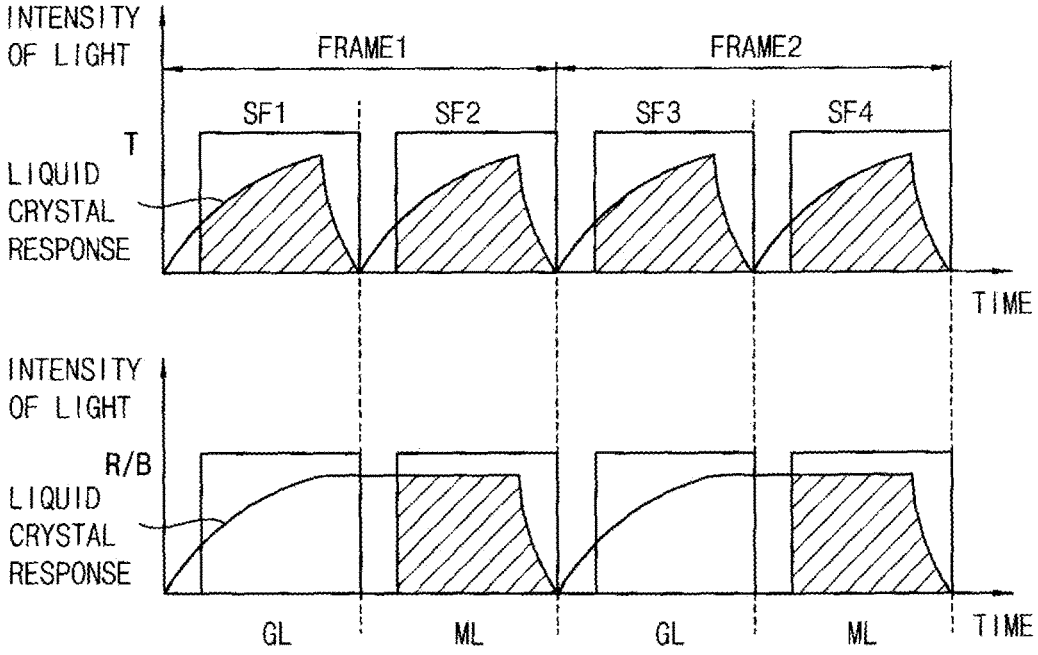
FIG. 16 is a conceptual diagram illustrating another alternative exemplary embodiment of a method of driving the display apparatus of FIG. 13 according to the invention.

FIG. 16 is a conceptual diagram illustrating another alternative exemplary embodiment of a method of driving the display apparatus of FIG. 13 according to the invention.

The method of driving the display apparatus shown in FIG. 16 is substantially the same as the method of driving the display apparatus in FIG. 14 except for a method of driving the display panel 100 and a method of driving the light source part. The method of driving the display apparatus shown in FIG. 16 is substantially the same as the method of driving the display apparatus in FIG. 12 except that the display panel 100 includes red, blue and transparent subpixels R, B and T, and the light source part 200 includes magenta and green light sources ML and GL. The same or like elements shown in FIG. 16 have been labeled with the same reference characters as used above to describe the exemplary embodiments of the method of driving the display apparatus shown in FIGS. 12 and 14, and any repetitive detailed description thereof will hereinafter be omitted or simplified.

In FIG. 16, a method of driving the transparent sub pixel T and a method of driving the first and second subpixels R and B are shown.

Referring to FIGS. 13 and 16, the display panel 100 displays red and blue using the first and second subpixels R and B, and magenta light of the first light source 210, which is mixed light of red light and blue light. The display panel 100 displays green using green light of the second light source 220.

In an exemplary embodiment of the method of driving the display panel 100, as shown in FIG. 16, the panel driver 300 sets same grayscale data of the first and second subpixels R and B during the first and second subframes SF1 and SF2, as in the exemplary embodiment of FIG. 12.

According to an exemplary embodiment, as described above, the first and second subpixels R and B are precharged during the first subframe SF1 such that the display panel 100 may effectively display a predetermined grayscale, and the display quality is thereby substantially improved.

Figure 17:
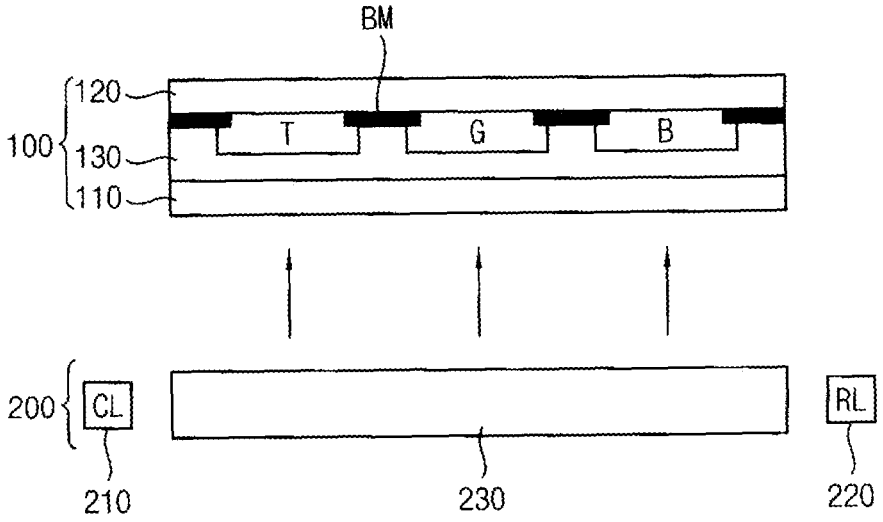
FIG. 17 is a cross-sectional view of a display panel and a light source part of an alternative exemplary embodiment of a display apparatus according to the invention.
Figure 18:
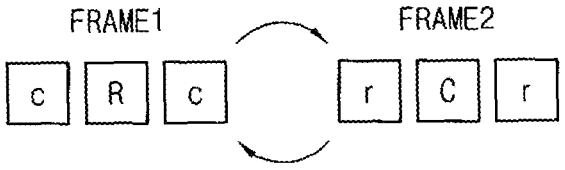
FIG. 18 is a conceptual diagram illustrating an exemplary embodiment of a method of driving the display apparatus of FIG. 17.

FIG. 17 is a cross-sectional view of a display panel and a light source part of another alternative exemplary embodiment of a display apparatus according to the invention. FIG. 18 is a conceptual diagram illustrating an exemplary embodiment of a method of driving the display apparatus of FIG. 17.

The display apparatus and the method of driving the display apparatus shown in FIGS. 17 and 18 are substantially the same as the display apparatus and the method of driving the display apparatus shown in FIGS. 1 to 8 except that a first subpixel is a green subpixel, a second subpixel is a blue subpixel, a first light source is a cyan light source and a second light source is a red light source. The same or like elements shown in FIGS. 17 to 18 have been labeled with the same reference characters as used above to describe the exemplary embodiments of the display apparatus and the method of driving the display apparatus shown in FIGS. 1 to 8, and any repetitive detailed description thereof will hereinafter be omitted or simplified.

Referring to FIGS. 1 and 17, the display apparatus includes a display panel 100, a light source part 200, a panel driver 300 and a light source driver 400.

The display panel 100 includes a first subpixel G having a first primary color, a second subpixel B having a second primary color and a transparent subpixel T.

In an exemplary embodiment, as shown in FIG. 17, the first primary color may be green, and the first subpixel G may be a green subpixel. In such an embodiment, the second primary color may be blue, and the second subpixel B may be a blue subpixel.

The first subpixel G may be defined by a green color filter disposed on the second substrate 120. The second subpixel B may be defined by a blue color filter disposed on the second substrate 120. The transparent subpixel T may be defined by a transparent color filter disposed on the second substrate 120. In one exemplary embodiment, for example, the transparent color filter may be defined by a substantially empty space at which no color filter is disposed. A light blocking pattern BM may be disposed between the color filters.

The panel driver 300 sets grayscale data of the first, second and transparent subpixels G, B and T.

The light source part 200 includes a first light source 210 and a second light source 220. The light source part 200 may further include a light guide plate 230. The light source part 200 generates light and provides the light to the display panel 100.

The first light source 210 generates light having a mixed color of the first primary color and the second primary color. In an exemplary embodiment, as shown in FIG. 17, the first primary color may be green, the second primary color may be blue, and the mixed color of the first and second primary colors may be cyan.

The second light source 220 generates light having a third primary color. The third primary color may be red.

The light source driver 400 is connected to the light source part 200. The light source driver 400 drives the light source part 200. In an exemplary embodiment, the light source driver 400 may alternately turn on the first and second light sources 210 and 220. In one exemplary embodiment, for example, during a first subframe, the first light source 210 is turned on and the second light source 220 is turned off. In such an embodiment, during a second subframe, the first light source 210 is turned off and the second light source 220 is turned on.

Referring to FIGS. 5, 17 and 18, a frame, e.g., a unit frame corresponding to a single input image datum, is divided into three subframes.

The light source driver 400 turns on the first light source 210 during the first subframe SF1. The light source driver 400 turns on the second light source 220 during the second subframe SF2. The light source driver 400 turns on the first light source 210 during the third subframe SF3. The light source driver 400 turns on the second light source 220 during the fourth subframe SF4. The light source driver 400 turns on the first light source 210 during the fifth subframe SF5. The light source driver 400 turns on the second light source 220 during the sixth subframe SF6.

The light source driver 400 controls the first light source 210 to emit light of a first intensity c during the first and third subframes SF1 and SF3, and to emit light of a second intensity C greater than the first intensity c during the fifth subframe SF5 in response to the same grayscale data.

The light source driver 400 controls the second light source 220 to emit light of a third intensity r during the fourth and sixth subframes SF4 and SF6, and to emit light of a fourth intensity R greater than the third intensity r during the second subframe SF2 in response to the same grayscale data.

According to an exemplary embodiment, the display panel 100 includes green, blue and transparent subpixels G, B and T, and the light source part 200 includes cyan and red light sources CL and RL, which are repeatedly turned on and off, such that the power consumption of the display apparatus substantially decreases. In such an embodiment, the color breakup is effectively prevented, and the display quality of the display apparatus is thereby substantially improved.

Figure 19:
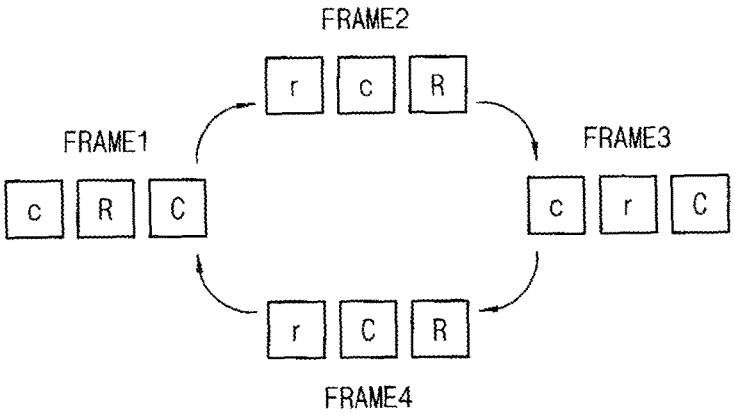
FIG. 19 is a conceptual diagram illustrating an alternative exemplary embodiment of a method of driving the display apparatus of FIG. 17 according to the invention.

FIG. 19 is a conceptual diagram illustrating an alternative exemplary embodiment of a method of driving the display apparatus of FIG. 17 according to the invention.

The method of driving the display apparatus shown in FIG. 19 is substantially the same as the method of driving the display apparatus in FIG. 18 except that the light source part 200 is driven in the unit of four frames. The method of driving the display apparatus shown in FIG. 19 is substantially the same as the method of driving the display apparatus in FIGS. 10 and 11 except that the display panel 100 includes green, blue and transparent subpixels G, B and T, and the light source part 200 includes cyan and red light sources CL and RL. The same or like elements shown in FIG. 19 have been labeled with the same reference characters as used above to describe the exemplary embodiments of the method of driving the display apparatus shown in FIGS. 10, 11 and 18, and any repetitive detailed description thereof will hereinafter be omitted or simplified.

Referring to FIGS. 11, 17 and 19, the light source driver 400 turns on the first light source 210 during the first subframe SF1. The light source driver 400 turns on the second light source 220 during the second subframe SF2. The light source driver 400 turns on the first light source 210 during the third subframe SF3. The light source driver 400 turns on the second light source 220 during the fourth subframe SF4. The light source driver 400 turns on the first light source 210 during the fifth subframe SF5. The light source driver 400 turns on the second light source 220 during the sixth subframe SF6. The light source driver 400 turns on the first light source 210 during the seventh subframe SF7. The light source driver 400 turns on the second light source 220 during the eighth subframe SF8. The light source driver 400 turns on the first light source 210 during the ninth subframe SF9. The light source driver 400 turns on the second light source 220 during the tenth subframe SF10. The light source driver 400 turns on first light source 210 during the eleventh subframe SF11. The light source driver 400 turns on the second light source 220 during the twelfth subframe SF12.

The light source driver 400 controls the first light source 210 to emit light of a first intensity c during the first, fifth and seventh subframes SF1, SF5 and SF7, and to emit light of a second intensity C greater than the first intensity c during the third, ninth and eleventh subframes SF3, SF9 and SF11 in response to the same grayscale data.

The light source driver 400 controls the second light source 220 to emit light of a third intensity r during the fourth, eighth and tenth subframes SF4, SF8, and SF10 and to emit light of a fourth intensity R greater than the third intensity r during the second, sixth and twelfth subframes SF2, SF6 and SF12 in response to the same grayscale data.

In an exemplary embodiment, during one of the third and fourth subframes SF3 and SF4, during one of the sixth and seventh subframes SF6 and SF7, during one of the ninth and tenth subframes SF9 and SF10 and during one of the twelfth and thirteenth subframes SF12 and SF13, which correspond to boundaries between the first to fourth frames FRAME1 to FRAME4, the first light source 210 or the second light source 220 emits light of a relatively low intensity, e.g., the first intensity c or the third intensity r, such that the color breakup is substantially reduced.

Figure 20:
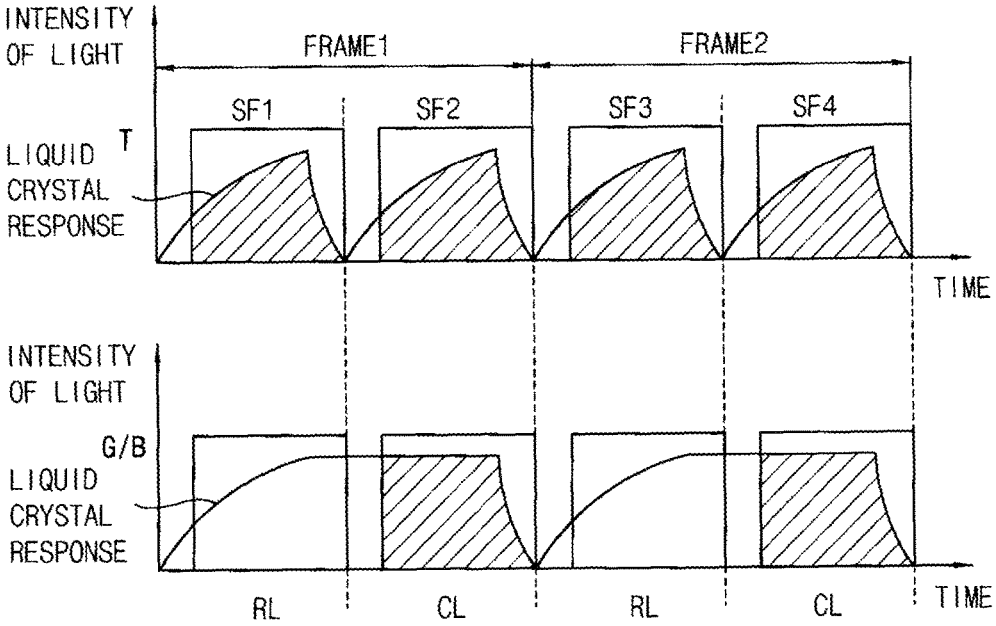
FIG. 20 is a conceptual diagram illustrating another alternative exemplary embodiment of a method of driving the display apparatus of FIG. 17 according to the invention.

FIG. 20 is a conceptual diagram illustrating another alternative exemplary embodiment of a method of driving the display apparatus of FIG. 17 according to the invention.

The method of driving the display apparatus shown in FIG. 20 is substantially the same as the method of driving the display apparatus in FIG. 18 except for a method of driving the display panel 100 and a method of driving the light source part. The method of driving the display apparatus shown in FIG. 20 is substantially the same as the method of driving the display apparatus in FIG. 12 except that the display panel 100 includes green, blue and transparent subpixels G, B and T, and the light source part 200 includes cyan and red light sources CL and RL. The same or like elements shown in FIG. 20 have been labeled with the same reference characters as used above to describe the exemplary embodiments of the method of driving the display apparatus shown in FIGS. 12 and 18, and any repetitive detailed description thereof will hereinafter be omitted or simplified.

In FIG. 20, a method of driving the transparent sub pixel T and a method of driving the first and second subpixels G and B are shown.

Referring to FIGS. 17 and 20, the display panel 100 displays green and blue using the first and second subpixels G and B, and magenta light of the first light source 210, which is mixed light of green light and blue light. The display panel 100 displays red using red light of the second light source 220.

In an exemplary embodiment of the method of driving the display panel 100, as shown in FIG. 20, the panel driver 300 sets same grayscale data of the first and second subpixels G and B during the first and second subframes SF1 and SF2.

According to an exemplary embodiment, as described above, the first and second subpixels G and B are precharged during the first subframe SF1 such that the display panel 100 may effectively display a predetermined grayscale, and the display quality is thereby improved.

Figure 21:
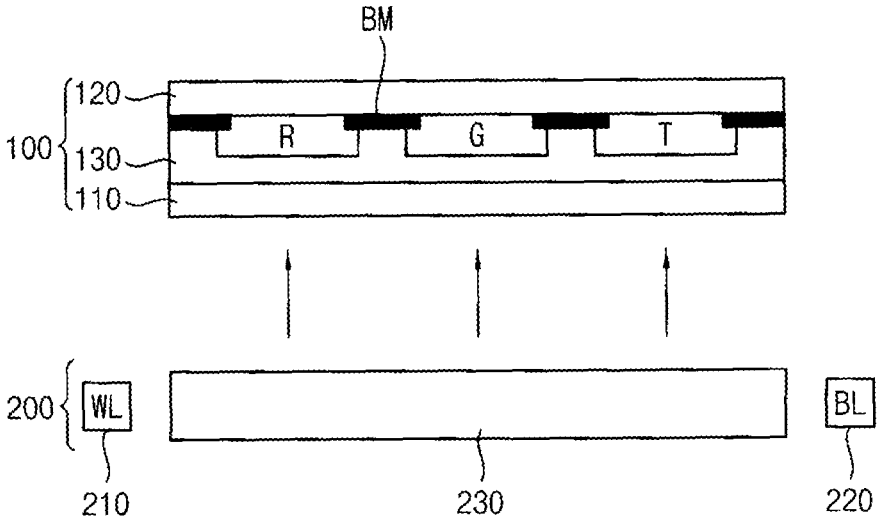
FIG. 21 is a cross-sectional view of a display panel and a light source part of another alternative exemplary embodiment of a display apparatus according to the invention.
Figure 22:
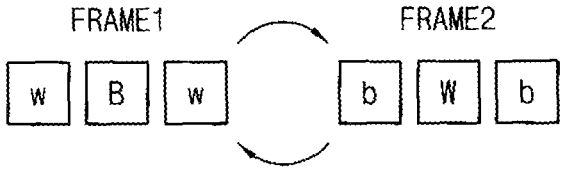
FIG. 22 is a conceptual diagram illustrating an exemplary embodiment of a method of driving the display apparatus of FIG. 21.

FIG. 21 is a cross-sectional view of a display panel and a light source part of an alternative exemplary embodiment of a display apparatus according to the invention. FIG. 22 is a conceptual diagram illustrating an exemplary embodiment of a method of driving the display apparatus of FIG. 21.

The display apparatus and the method of driving the same shown in FIGS. 21 and 22 are substantially the same as the display apparatus and the method of driving the same in FIGS. 1 to 8 except that a first light source is a white light source. The same or like elements shown in FIGS. 21 and 22 have been labeled with the same reference characters as used above to describe the exemplary embodiments of the display apparatus and the method of driving the display apparatus shown in FIGS. 1 to 8, and any repetitive detailed description thereof will hereinafter be omitted or simplified.

Referring to FIGS. 1 and 21, the display apparatus includes a display panel 100, a light source part 200, a panel driver 300 and a light source driver 400.

The display panel 100 includes a first subpixel R having a first primary color, a second subpixel G having a second primary color and a transparent subpixel T.

In an exemplary embodiment, the first primary color may be red, and the first subpixel R may be a red subpixel. In such an embodiment, the second primary color may be green, and the second subpixel G may be a green subpixel.

The first subpixel R may be defined by a red color filter disposed on the second substrate 120. The second subpixel G may be defined by a green color filter disposed on the second substrate 120. The transparent subpixel T may be defined by a transparent color filter disposed on the second substrate 120. In one exemplary embodiment, for example, the transparent color filter may be defined by a substantially empty space at which no color filter is disposed. A light blocking pattern BM may be disposed between the color filters.

The panel driver 300 sets grayscale data of the first, second and transparent subpixels R, G and T.

The light source part 200 includes a first light source 210 and a second light source 220. The light source part 200 may further include a light guide plate 230. The light source part 200 generates light and provides the light to the display panel 100.

The first light source 210 generates white light. The second light source 220 generates light having a third primary color. The third primary color may be blue.

The light source driver 400 is connected to the light source part 200. The light source driver 400 drives the light source part 200. In an exemplary embodiment, as shown in FIG. 21, the light source driver 400 may alternately turn on the first and second light sources 210 and 220. In one exemplary embodiment, for example, during a first subframe, the first light source 210 is turned on and the second light source 220 is turned off. In such an embodiment, during a second subframe, the first light source 210 is turned off and the second light source 220 is turned on.

The panel driver 300 operates subpixel rendering to set grayscale data of the first subpixel R, the second subpixel G and the transparent subpixel T.

Referring to FIGS. 5, 21 and 22, a frame, e.g., a unit frame corresponding to a single input image datum, is divided into three subframes.

The light source driver 400 turns on the first light source 210 during the first subframe SF1. The light source driver 400 turns on the second light source 220 during the second subframe SF2. The light source driver 400 turns on the first light source 210 during the third subframe SF3. The light source driver 400 turns on the second light source 220 during the fourth subframe SF4. The light source driver 400 turns on the first light source 210 during the fifth subframe SF5. The light source driver 400 turns on the second light source 220 during the sixth subframe SF6.

The light source driver 400 controls the first light source 210 to emit light of a first intensity w during the first and third subframes SF1 and SF3, and to emit light of a second intensity W greater than the first intensity w during the fifth subframe SF5 in response to the same grayscale data.

The light source driver 400 controls the second light source 220 to emit light of a third intensity b during the fourth and sixth subframes SF4 and SF6, and to emit light of a fourth intensity B greater than the third intensity b during the second subframe SF2 in response to the same grayscale data.

In an exemplary embodiment, during the first sub frame SF1 and the third subframe SF3, when the state of the liquid crystal molecule is changed, the first light source 210 has a relatively low intensity, e.g., the first intensity w, such that the decrease of the luminance due to a delay of the liquid crystal response is substantially reduced during the first frame FRAME1.

In such an embodiment, during one of the third subframe SF3 and the fourth subframe SF4, which correspond to a boundary between the first frame FRAME1 and the second frame FRAME2, the first light source 210 or the second light source 220 emits light of a relatively low intensity, e.g., the first intensity w or the third intensity b, such that the color breakup may be reduced.

Figure 23:
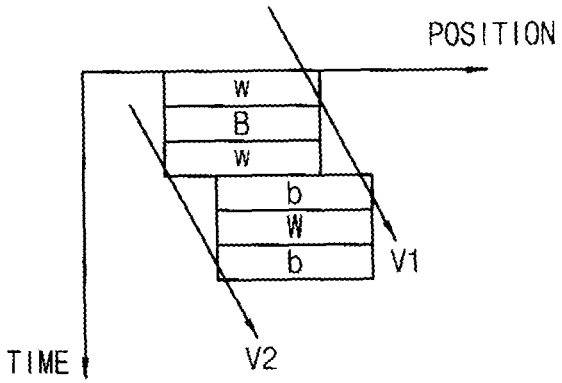
FIGS. 23 and 24 are conceptual diagrams illustrating an exemplary embodiment of an image displayed on the display panel of FIG. 21 based on the method of driving the display apparatus of FIG. 22.
Figure 24:
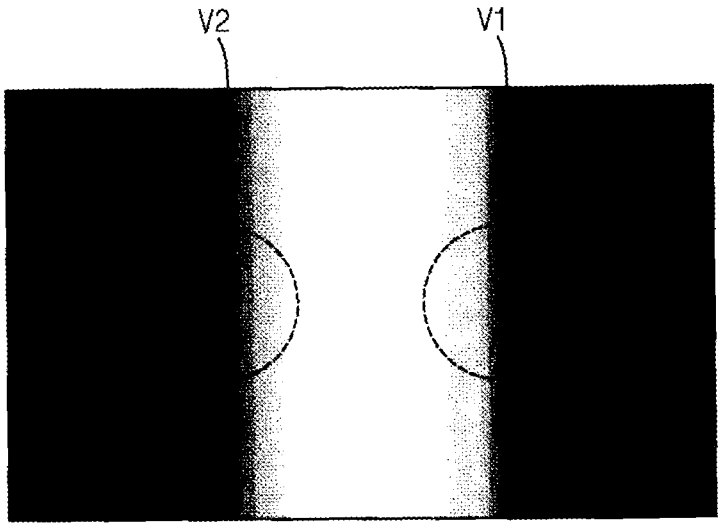

FIGS. 23 and 24 are conceptual diagrams illustrating an exemplary embodiment of an image displayed on the display panel of FIG. 21 based on the method of driving the display apparatus of FIG. 22.

FIG. 23 shows an exemplary embodiment, in which an image of white rectangle is moving in a horizontal direction on the display panel 100.

Referring to FIG. 23, an upper rectangle shows the image of the white rectangle during the first frame FRAME1, and a lower rectangle shows the image of the white rectangle during the second frame FRAME2.

During the first frame FRAME1, the first and second light sources 210 and 220 sequentially emit the light of the first intensity w, fourth intensity B and the first intensity w. During the second frame FRAME2 when the image is displaced in a horizontal direction from the image of the first frame FRAME1, the first and second light sources 210 and 220 sequentially emit the light of the third intensity b, the second intensity W and the third intensity b.

Referring to FIGS. 23 and 24, a viewpoint of a viewer moves according to a movement of the image of the white rectangle.

When the viewpoint of the viewer corresponds to a first viewpoint V1, a mixed color of white w and blue b are shown to the viewer such that the viewer recognizes an image of light blue which is close to an achromatic color. Thus, the color breakup is substantially reduced. In the first viewpoint V1, each of the first light source 210 and the second light source 220 emits the light of the relatively low intensity, e.g., the first intensity w or the third intensity b, such that the movement of the image may be recognized substantially smoothly.

When the viewpoint of the viewer corresponds to a second viewpoint V2, a mixed color of white w and blue b are shown to the viewer such that the viewer recognizes an image of light blue, which is substantially close to an achromatic color. Thus, the color breakup is substantially reduced. In the second viewpoint V2, each of the first light source 210 and the second light source 220 emits the light of the relatively low intensity, e.g., the first intensity w or the third intensity b, such that the movement of the image may be recognized substantially smoothly.

According to an exemplary embodiment, the display panel 100 includes red, green and transparent subpixels R, G and T, and the light source part 200 includes white and blue light sources WL and BL, which are repeatedly turned on and off, such that the power consumption of the display apparatus substantially decreases. In such an embodiment, the color breakup is effectively prevented, and the display quality of the display apparatus is thereby substantially improved.

Figure 25:
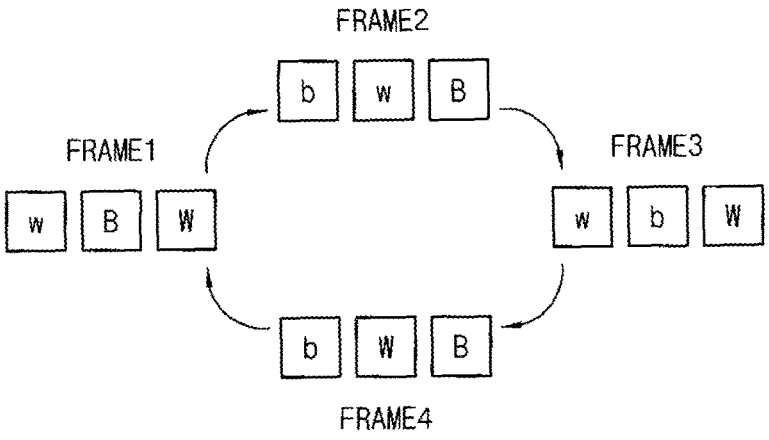
FIG. 25 is a conceptual diagram illustrating an alternative exemplary embodiment of a method of driving the display apparatus of FIG. 21 according to the invention.

FIG. 25 is a conceptual diagram illustrating an alternative exemplary embodiment of a method of driving the display apparatus of FIG. 21 according to the invention.

The method of driving the display apparatus shown in FIG. 25 is substantially the same as the method of driving the display apparatus in FIG. 22 except that the light source part 200 is driven in the unit of four frames. The method of driving the display apparatus shown in FIG. 25 is substantially the same as the method of driving the display apparatus in FIGS. 10 and 11 except that the display panel 100 includes red, green and transparent subpixels R, G and T, and the light source part 200 includes white and blue light sources WL and BL. The same or like elements shown in FIG. 25 have been labeled with the same reference characters as used above to describe the exemplary embodiments of the method of driving the display apparatus shown in FIGS. 10, 11 and 22, and any repetitive detailed description thereof will hereinafter be omitted or simplified.

Referring to FIGS. 11, 21 and 25, the light source driver 400 turns on the first light source 210 during the first subframe SF1. The light source driver 400 turns on the second light source 220 during the second subframe SF2. The light source driver 400 turns on the first light source 210 during the third subframe SF3. The light source driver 400 turns on the second light source 220 during the fourth subframe SF4. The light source driver 400 turns on the first light source 210 during the fifth subframe SF5. The light source driver 400 turns on the second light source 220 during the sixth subframe SF6. The light source driver 400 turns on the first light source 210 during the seventh subframe SF7. The light source driver 400 turns on the second light source 220 during the eighth subframe SF8. The light source driver 400 turns on the first light source 210 during the ninth subframe SF9. The light source driver 400 turns on the second light source 220 during the tenth subframe SF10. The light source driver 400 turns on first light source 210 during the eleventh subframe SF11. The light source driver 400 turns on the second light source 220 during the twelfth subframe SF12.

The light source driver 400 controls the first light source 210 to emit light of a first intensity w during the first, fifth and seventh subframes SF1, SF5 and SF7, and to emit light of a second intensity W greater than the first intensity w during the third, ninth and eleventh subframes SF3, SF9 and SF11 in response to the same grayscale data.

The light source driver 400 controls the second light source 220 to emit light of a third intensity b during the fourth, eighth and tenth subframes SF4, SF8 and SF10, and to emit light of a fourth intensity B greater than the third intensity b during the second, sixth and twelfth subframes SF2, SF6 and SF12 in response to the same grayscale data.

In an exemplary embodiment, during one of the third and fourth subframes SF3 and SF4, during one of the sixth and seventh subframes SF6 and SF7, during one of the ninth and tenth subframes SF9 and SF10 and during one of the twelfth and thirteenth subframes SF12 and SF13, which correspond to boundaries between the first to fourth frames FRAME1 to FRAME4, the first light source 210 or the second light source 220 emits a relatively low intensity, e.g., the first intensity w or the third intensity b, such that the color breakup is substantially reduced.

Figure 26:
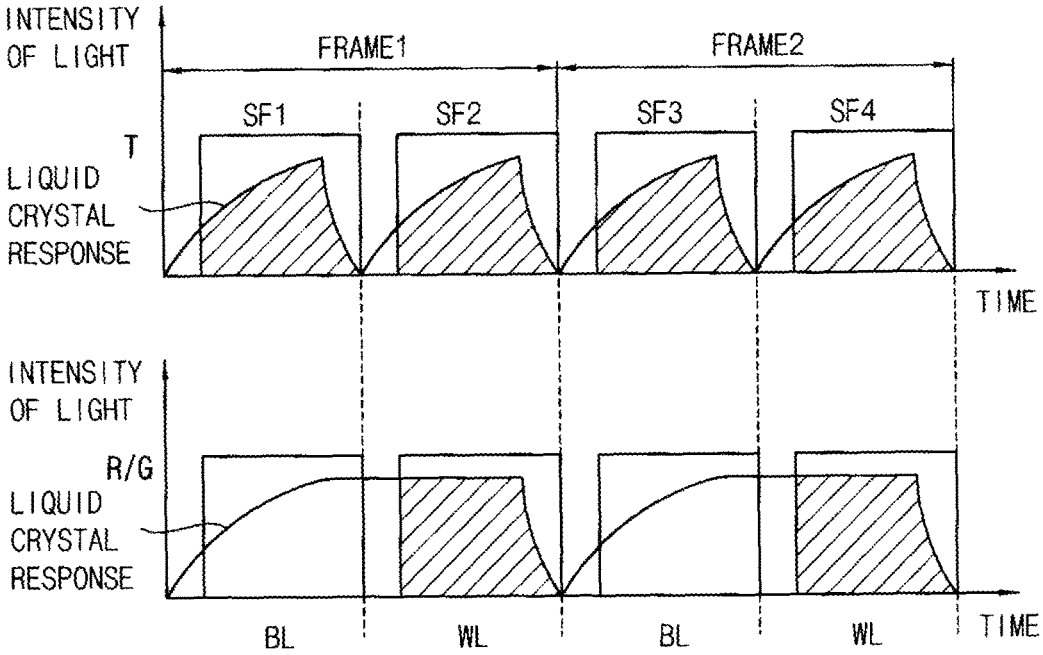
FIG. 26 is a conceptual diagram illustrating another alternative exemplary embodiment of a method of driving the display apparatus of FIG. 21 according to the invention.

FIG. 26 is a conceptual diagram illustrating another alternative exemplary embodiment of a method of driving the display apparatus of FIG. 22 according to the invention.

The method of driving the display apparatus shown in FIG. 26 is substantially the same as the method of driving the display apparatus in FIG. 22 except for a method of driving the display panel 100 and a method of driving the light source part. The method of driving the display apparatus shown in FIG. 26 is substantially the same as the method of driving the display apparatus in FIG. 12 except that the display panel 100 includes red, green and transparent subpixels R, G and T, and the light source part 200 includes white and blue light sources WL and BL. The same or like elements shown in FIG. 26 have been labeled with the same reference characters as used above to describe the exemplary embodiments of the method of driving the display apparatus shown in FIGS. 12 and 22, and any repetitive detailed description thereof will hereinafter be omitted or simplified.

In FIG. 26, a method of driving the transparent sub pixel T and a method of driving the first and second subpixels R and G are shown.

Referring to FIGS. 21 and 26, the display panel 100 displays red and green using the first and second subpixels R and G and white light of the first light source 210. The display panel 100 displays blue using the white light of the first light source 210 and blue light of the second light source 220.

In an exemplary embodiment, as shown in FIG. 26, during the first and third subframes SF1 and SF3, the second light source 220 that emits the blue light is turned on. During the second and fourth subframes SF2 and SF4, the first light source 210 that emits the white light is turned on.

As described above, if the transparent subpixel T is driven substantially the same as the first and second subpixels R and G, the display panel 100 may not display a full grayscale of the red color and a full grayscale of the green color.

In an exemplary embodiment of the method of driving the display panel 100, the panel driver 300 sets same grayscale data of the first and second subpixels R and G during the first and second subframes SF1 and SF2.

The panel driver 300 sets grayscale data of the first and second subpixels R and G corresponding to the grayscale data for the second subframe SF2 during the first and second subframes SF1 and SF2.

During the first subframe SF1, the blue light BL is turned on, such that the first and second subpixels R and G do not transmit the light although liquid crystal molecules corresponding to the first and second subpixels R and G is in the transmitting state. Thus, the image displayed during the first subframe SF1 is not changed although the grayscale data of the first and second subpixels R and G is precharged during the first subframe SF1.

The grayscale data corresponding to the second subframe SF2 are precharged to the first and second subpixels R and G during the first subframe SF1 such that the slow liquid crystal response is effectively compensated, and the luminance of the first and second subpixels R and G during the second subframe SF2 is substantially improved.

In such an embodiment, the panel driver 300 sets first grayscale data of the transparent subpixel T corresponding to the first subframe SF1 during the first subframe SF1 and second grayscale data of the transparent subpixel T corresponding to the second subframe SF2 during the second subframe SF2.

According to an exemplary embodiment, as described above, the first and second subpixels R and G are precharged during the first subframe SF1 such that the display panel 100 may effectively display a predetermined grayscale, and the display quality is thereby improved.

Figure 27:
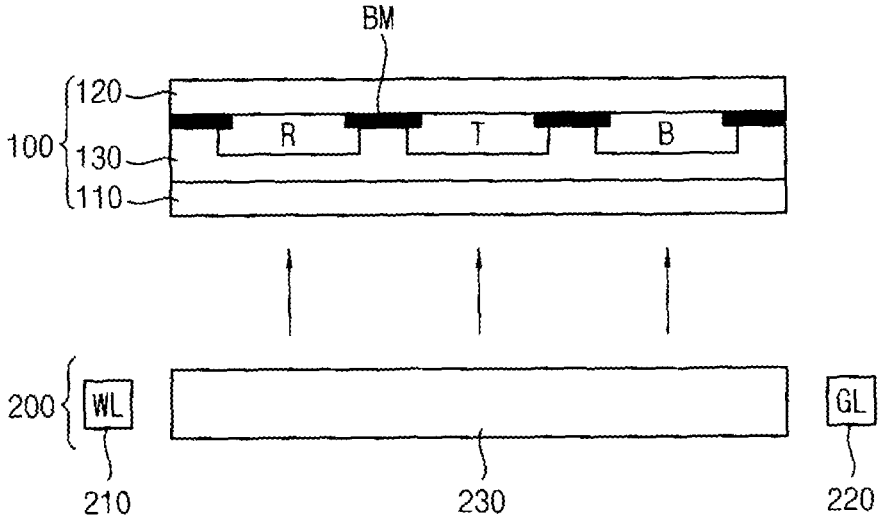
FIG. 27 is a cross-sectional view of a display panel and a light source part of another alternative exemplary embodiment of a display apparatus according to the invention.
Figure 28:
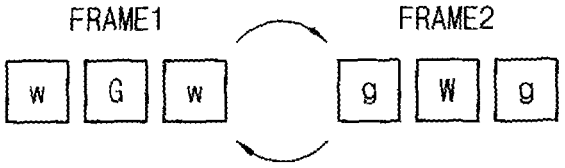
FIG. 28 is a conceptual diagram illustrating an exemplary embodiment of a method of driving the display apparatus of FIG. 27.

FIG. 27 is a cross-sectional view of a display panel and a light source part of an alternative exemplary embodiment of a display apparatus according to the invention. FIG. 28 is a conceptual diagram illustrating an exemplary embodiment of a method of driving the display apparatus of FIG. 27.

The display apparatus and the method of driving the display apparatus shown in FIGS. 27 and 28 are substantially the same as the display apparatus and the method of driving the display apparatus shown in FIGS. 13 and 14 except that a first light source is a white light source. The same or like elements shown in FIGS. 27 to 28 have been labeled with the same reference characters as used above to describe the exemplary embodiments of the display apparatus and the method of driving the display apparatus shown in FIGS. 13 and 14, and any repetitive detailed description thereof will hereinafter be omitted or simplified.

Referring to FIGS. 1 and 27, the display apparatus includes a display panel 100, a light source part 200, a panel driver 300 and a light source driver 400.

The display panel 100 includes a first subpixel R having a first primary color, a second subpixel B having a second primary color and a transparent subpixel T.

In an exemplary embodiment, as shown in FIG. 27, the first primary color may be red, and the first subpixel R may be a red subpixel. In such an embodiment, the second primary color may be blue, and the second subpixel B may be a blue subpixel.

The first subpixel R may be defined by a red color filter disposed on the second substrate 120. The second subpixel B may be defined by a blue color filter disposed on the second substrate 120. The transparent subpixel T may be defined by a transparent color filter disposed on the second substrate 120. In one exemplary embodiment, for example, the transparent color filter may be defined by a substantially empty space at which no color filter is disposed. A light blocking pattern BM may be disposed between the color filters.

The panel driver 300 sets grayscale data of the first, second and transparent subpixels R, B and T.

The light source part 200 includes a first light source 210 and a second light source 220. The light source part 200 may further include a light guide plate 230. The light source part 200 generates light and provides the light to the display panel 100.

In an exemplary embodiment, the first light source 210 generates white light. The second light source 220 generates light having a third primary color. The third primary color may be green.

The light source driver 400 is connected to the light source part 200. The light source driver 400 drives the light source part 200. In the exemplary embodiment, the light source driver 400 may alternately turn on the first and second light sources 210 and 220. In one exemplary embodiment, for example, during a first subframe, the first light source 210 is turned on and the second light source 220 is turned off. In such an embodiment, during a second subframe, the first light source 210 is turned off and the second light source 220 is turned on.

Referring to FIGS. 5, 27 and 28, a frame, e.g., a unit frame corresponding to a single input image datum, is divided into three subframes.

The light source driver 400 turns on the first light source 210 during the first subframe SF1. The light source driver 400 turns on the second light source 220 during the second subframe SF2. The light source driver 400 turns on the first light source 210 during the third subframe SF3. The light source driver 400 turns on the second light source 220 during the fourth subframe SF4. The light source driver 400 turns on the first light source 210 during the fifth subframe SF5. The light source driver 400 turns on the second light source 220 during the sixth subframe SF6.

The light source driver 400 controls the first light source 210 to emit light of a first intensity w during the first and third subframes SF1 and SF3, and to emit light of a second intensity W greater than the first intensity w during the fifth subframe SF5 in response to the same grayscale data.

The light source driver 400 controls the second light source 220 to emit light of a third intensity g during the fourth and sixth subframes SF4 and SF6, and to emit light of a fourth intensity G greater than the third intensity g during the second subframe SF2 in response to the same grayscale data.

According to an exemplary embodiment, the display panel 100 includes red, blue and transparent subpixels R, B and T and the light source part 200 includes white and green light sources WL and GL, which are repeatedly turned on and off, such that the power consumption of the display apparatus substantially decreases. In such an embodiment, the color breakup is effectively prevented, and the display quality of the display apparatus is thereby substantially improved.

Figure 29:
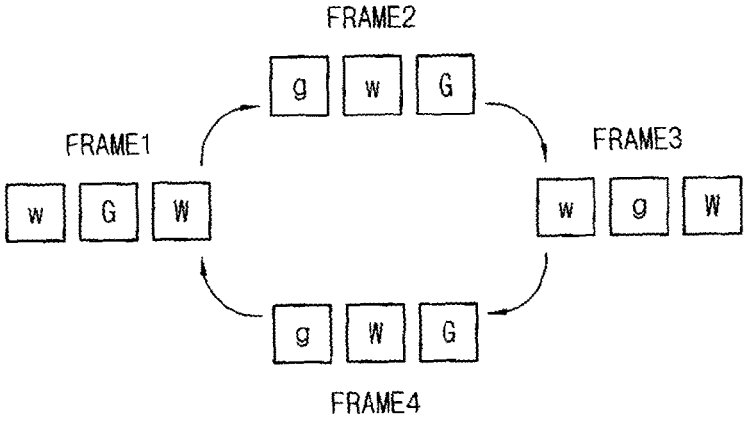
FIG. 29 is a conceptual diagram illustrating an alternative exemplary embodiment of a method of driving the display apparatus of FIG. 27 according to the invention.

FIG. 29 is a conceptual diagram illustrating an alternative exemplary embodiment of a method of driving the display apparatus of FIG. 27 according to the invention.

The method of driving the display apparatus shown in FIG. 29 is substantially the same as the method of driving the display apparatus in FIG. 28 except that the light source part 200 is driven in the unit of four frames. The method of driving the display apparatus shown in FIG. 29 is substantially the same as the method of driving the display apparatus in FIGS. 10 and 11 except that the display panel 100 includes red, blue and transparent subpixels R, B and T and the light source part 200 includes white and green light sources WL and GL. The same or like elements shown in FIG. 29 have been labeled with the same reference characters as used above to describe the exemplary embodiments of the method of driving the display apparatus shown in FIGS. 10, 11 and 28, and any repetitive detailed description thereof will hereinafter be omitted or simplified.

Referring to FIGS. 11 and 27 and 29, the light source driver 400 turns on the first light source 210 during the first subframe SF1. The light source driver 400 turns on the second light source 220 during the second subframe SF2. The light source driver 400 turns on the first light source 210 during the third subframe SF3. The light source driver 400 turns on the second light source 220 during the fourth subframe SF4. The light source driver 400 turns on the first light source 210 during the fifth subframe SF5. The light source driver 400 turns on the second light source 220 during the sixth subframe SF6. The light source driver 400 turns on the first light source 210 during the seventh subframe SF7. The light source driver 400 turns on the second light source 220 during the eighth subframe SF8. The light source driver 400 turns on the first light source 210 during the ninth subframe SF9. The light source driver 400 turns on the second light source 220 during the tenth subframe SF10. The light source driver 400 turns on first light source 210 during the eleventh subframe SF11. The light source driver 400 turns on the second light source 220 during the twelfth subframe SF12.

The light source driver 400 controls the first light source 210 to emit light of a first intensity w during the first, fifth and seventh subframes SF1, SF5 and SF7, and to emit light of a second intensity W greater than the first intensity w during the third, ninth and eleventh subframes SF3, SF9 and SF11 in response to the same grayscale data.

The light source driver 400 controls the second light source 220 to emit light of a third intensity g during the fourth, eighth and tenth subframes SF4, SF8 and SF10, and to emit light of a fourth intensity G greater than the third intensity g during the second, sixth and twelfth subframes SF2, SF6 and SF12 in response to the same grayscale data.

In the exemplary embodiment, during one of the third and fourth subframes SF3 and SF4, during one of the sixth and seventh subframes SF6 and SF7, during one of the ninth and tenth subframes SF9 and SF10 and during one of the twelfth and thirteenth subframes SF12 and SF13, which correspond to boundaries between the first to fourth frames FRAME1 to FRAME4, the first light source 210 or the second light source 220 emits light of a relatively low intensity, e.g., the first intensity w or the third intensity g, such that the color breakup is substantially reduced.

Figure 30:
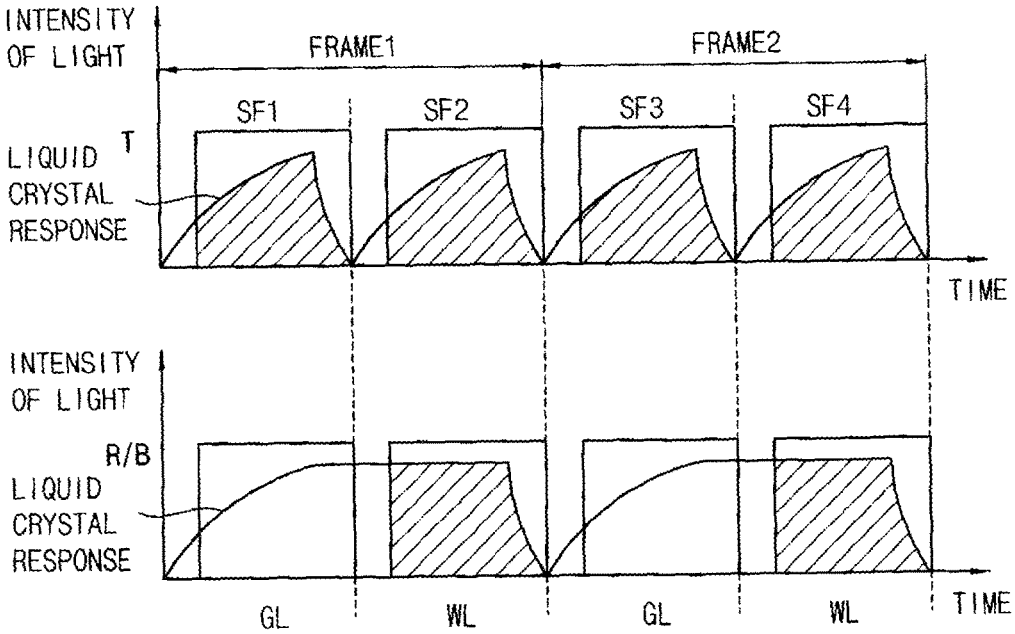
FIG. 30 is a conceptual diagram illustrating another alternative exemplary embodiment of a method of driving the display apparatus of FIG. 27 according to the invention.

FIG. 30 is a conceptual diagram illustrating another alternative exemplary embodiment of a method of driving the display apparatus of FIG. 27 according to the invention.

The method of driving the display apparatus shown in FIG. 30 is substantially the same as the method of driving the display apparatus in FIG. 28 except for a method of driving the display panel 100 and a method of driving the light source part. The method of driving the display apparatus shown in FIG. 30 is substantially the same as the method of driving the display apparatus in FIG. 12 except that the display panel 100 includes red, blue and transparent subpixels R, B and T and the light source part 200 includes white and green light sources WL and GL. The same or like elements shown in FIG. 30 have been labeled with the same reference characters as used above to describe the exemplary embodiments of the method of driving the display apparatus shown in FIGS. 12 and 28, and any repetitive detailed description thereof will hereinafter be omitted or simplified.

In FIG. 30, a method of driving the transparent sub pixel T and a method of driving the first and second subpixels R and B are shown.

Referring to FIGS. 27 and 30, the display panel 100 displays red and blue using the first and second subpixels R and B and white light of the first light source 210. The display panel 100 represents green using the white light of the first light source 210 and green light of the second light source 220.

In an exemplary embodiment of the method of driving the display panel 100, the panel driver 300 sets same grayscale data of the first and second subpixels R and B during the first and second subframes SF1 and SF2.

According to an exemplary embodiment, as described above, the first and second subpixels R and B are precharged during the first subframe SF1 such that the display panel 100 may effectively display a predetermined grayscale, and the display quality is thereby substantially improved.

Figure 31:
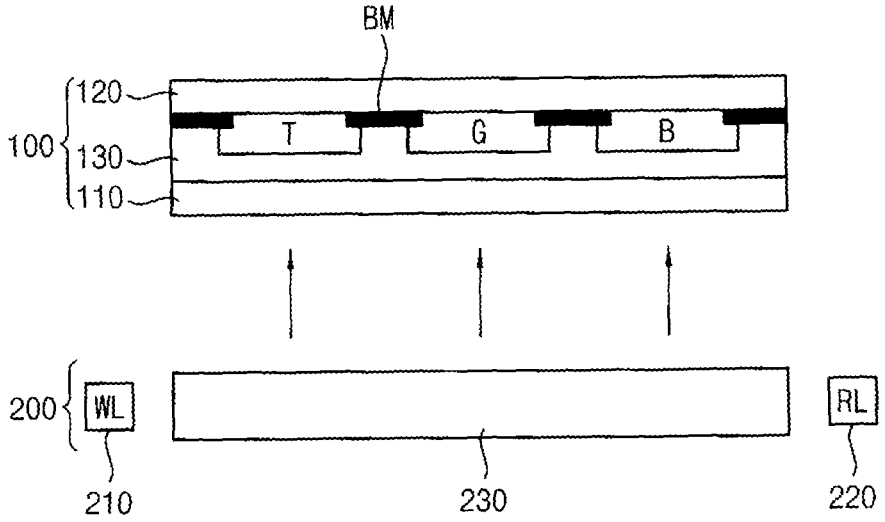
FIG. 31 is a cross-sectional view of a display panel and a light source part of another alternative exemplary embodiment of a display apparatus according to the invention.
Figure 32:
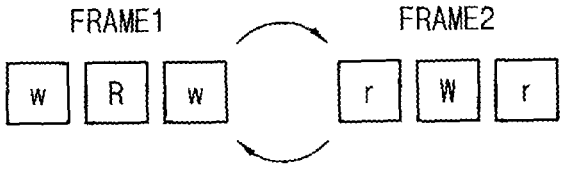
FIG. 32 is a conceptual diagram illustrating an exemplary embodiment of a method of driving the display apparatus of FIG. 31.

FIG. 31 is a cross-sectional view of a display panel and a light source part of another alternative exemplary embodiment of a display apparatus according to an exemplary embodiment of the invention. FIG. 32 is a conceptual diagram illustrating an exemplary embodiment of a method of driving the display apparatus of FIG. 31.

The display apparatus and the method of driving the display apparatus shown in FIGS. 31 and 32 are substantially the display apparatus as the display apparatus and the method of driving the same in FIGS. 17 and 18 except that a first light source is a white light source. The same or like elements shown in FIGS. 31 and 32 have been labeled with the same reference characters as used above to describe the exemplary embodiments of the display apparatus and the method of driving the display apparatus shown in FIGS. 17 and 18, and any repetitive detailed description thereof will hereinafter be omitted or simplified.

Referring to FIGS. 1 and 31, the display apparatus includes a display panel 100, a light source part 200, a panel driver 300 and a light source driver 400.

The display panel 100 includes a first subpixel G having a first primary color, a second subpixel B having a second primary color and a transparent subpixel T.

In an exemplary embodiment, as shown in FIG. 31, the first primary color may be green, and the first subpixel G is a green subpixel. In such an embodiment, the second primary color may be blue, and the second subpixel B may be a blue subpixel.

The first subpixel G may be defined by a green color filter disposed on the second substrate 120. The second subpixel B may be defined by a blue color filter disposed on the second substrate 120. The transparent subpixel T may be defined by a transparent color filter disposed on the second substrate 120. In one exemplary embodiment, for example, the transparent color filter may be defined by a substantially empty space, at which no color filter is disposed. A light blocking pattern BM may be disposed between the color filters.

The panel driver 300 sets grayscale data of the first, second and transparent subpixels G, B and T.

The light source part 200 includes a first light source 210 and a second light source 220. The light source part 200 may further include a light guide plate 230. The light source part 200 generates light and provides the light to the display panel 100.

The first light source 210 generates white light. The second light source 220 generates light having a third primary color. The third primary color may be red.

The light source driver 400 is connected to the light source part 200. The light source driver 400 drives the light source part 200. In an exemplary embodiment, as shown in FIGS. 31 and 32, the light source driver 400 may alternately turn on the first and second light sources 210 and 220. In one exemplary embodiment, for example, during a first subframe, the first light source 210 is turned on and the second light source 220 is turned off. In such an embodiment, during a second subframe, the first light source 210 is turned off and the second light source 220 is turned on.

Referring to FIGS. 5, 31 and 32, a frame, e.g., a unit frame corresponding to a single input image datum, is divided into three subframes.

The light source driver 400 turns on the first light source 210 during the first subframe SF1. The light source driver 400 turns on the second light source 220 during the second subframe SF2. The light source driver 400 turns on the first light source 210 during the third subframe SF3. The light source driver 400 turns on the second light source 220 during the fourth subframe SF4. The light source driver 400 turns on the first light source 210 during the fifth subframe SF5. The light source driver 400 turns on the second light source 220 during the sixth subframe SF6.

The light source driver 400 controls the first light source 210 to emit light of a first intensity w during the first and third subframes SF1 and SF3, and to emit light of a second intensity W greater than the first intensity w during the fifth subframe SF5 in response to the same grayscale data.

The light source driver 400 controls the second light source 220 to emit light of a third intensity r during the fourth and sixth subframes SF4 and SF6, and to emit light of a fourth intensity R greater than the third intensity r during the second subframe SF2 in response to the same grayscale data.

According to an exemplary embodiment, the display panel 100 includes green, blue and transparent subpixels G, B and T and the light source part 200 includes white and red light sources WL and RL, which are repeatedly turned on and off, such that the power consumption of the display apparatus substantially decreases. In such an embodiment, the color breakup is effectively prevented, and the display quality of the display apparatus is thereby substantially improved.

Figure 33:
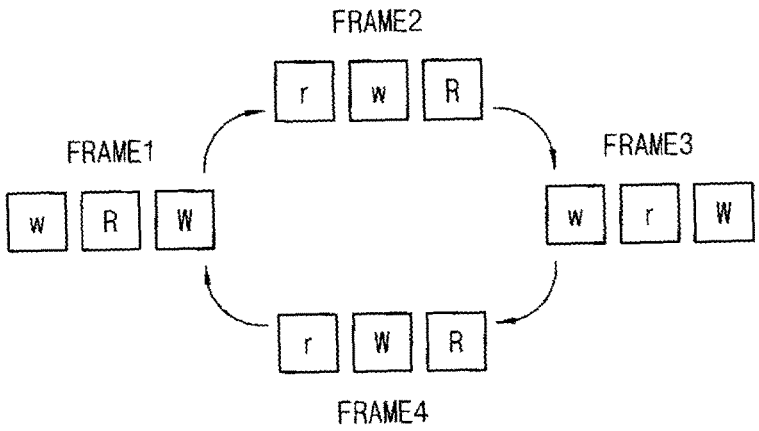
FIG. 33 is a conceptual diagram illustrating an alternative exemplary embodiment of a method of driving the display apparatus of FIG. 31 according to the invention.

FIG. 33 is a conceptual diagram illustrating an alternative exemplary embodiment of a method of driving the display apparatus of FIG. 31 according to the invention.

The method of driving the display apparatus shown in FIG. 33 is substantially the same as the method of driving the display apparatus in FIG. 32 except that the light source part 200 is driven in the unit of four frames. The method of driving the display apparatus shown in FIG. 33 is substantially the same as the method of driving the display apparatus in FIGS. 10 and 11 except that the display panel 100 includes green, blue and transparent subpixels G, B and T and the light source part 200 includes white and red light sources WL and RL. The same or like elements shown in FIG. 33 have been labeled with the same reference characters as used above to describe the exemplary embodiments of the method of driving the display apparatus shown in FIGS. 10, 11 and 32, and any repetitive detailed description thereof will hereinafter be omitted or simplified.

Referring to FIGS. 11, 31 and 33, the light source driver 400 turns on the first light source 210 during the first subframe SF1. The light source driver 400 turns on the second light source 220 during the second subframe SF2. The light source driver 400 turns on the first light source 210 during the third subframe SF3. The light source driver 400 turns on the second light source 220 during the fourth subframe SF4. The light source driver 400 turns on the first light source 210 during the fifth subframe SF5. The light source driver 400 turns on the second light source 220 during the sixth subframe SF6. The light source driver 400 turns on the first light source 210 during the seventh subframe SF7. The light source driver 400 turns on the second light source 220 during the eighth subframe SF8. The light source driver 400 turns on the first light source 210 during the ninth subframe SF9. The light source driver 400 turns on the second light source 220 during the tenth subframe SF10. The light source driver 400 turns on first light source 210 during the eleventh subframe SF11. The light source driver 400 turns on the second light source 220 during the twelfth subframe SF12.

The light source driver 400 controls the first light source 210 to emit light of a first intensity w during the first, fifth and seventh subframes SF1, SF5 and SF7, and to emit light of a second intensity W greater than the first intensity w during the third, ninth and eleventh subframes SF3, SF9 and SF11 in response to the same grayscale data.

The light source driver 400 controls the second light source 220 to emit light of a third intensity r during the fourth, eighth and tenth subframes SF4, SF8 and SF10, and to emit light of a fourth intensity R greater than the third intensity r during the second, sixth and twelfth subframes SF2, SF6 and SF12 in response to the same grayscale data.

In an exemplary embodiment, during one of the third and fourth subframes SF3 and SF4, during one of the sixth and seventh subframes SF6 and SF7, during one of the ninth and tenth subframes SF9 and SF10 and during one of the twelfth and thirteenth subframes SF12 and SF13, which correspond to boundaries between the first to fourth frames FRAME1 to FRAME4, the first light source 210 or the second light source 220 emits light of a relatively low intensity, e.g., the first intensity w or the third intensity r, such that the color breakup is substantially reduced.

Figure 34:
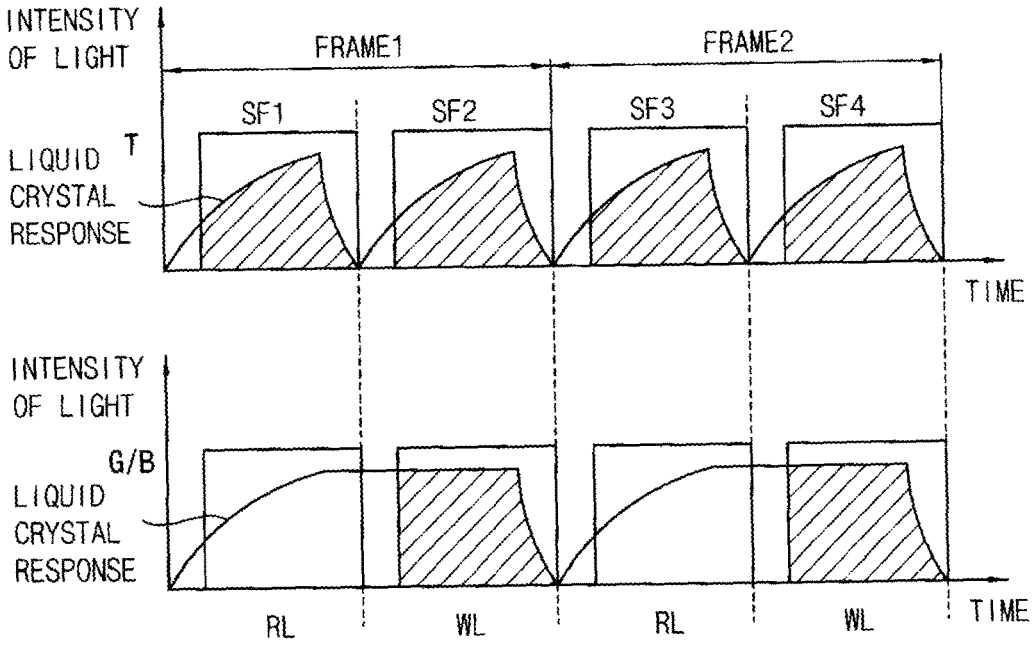
FIG. 34 is a conceptual diagram illustrating another alternative exemplary embodiment of a method of driving the display apparatus of FIG. 31 according to the invention.

FIG. 34 is a conceptual diagram illustrating another alternative exemplary embodiment of a method of driving the display apparatus of FIG. 31 according to the invention.

The method of driving the display apparatus shown in FIG. 34 is substantially the same as the method of driving the display apparatus in FIG. 32 except for a method of driving the display panel 100 and a method of driving the light source part. The method of driving the display apparatus shown in FIG. 20 is substantially the same as the method of driving the display apparatus in FIG. 12 except that the display panel 100 includes green, blue and transparent subpixels G, B and T and the light source part 200 includes white and red light sources WL and RL. The same or like elements shown in FIG. 34 have been labeled with the same reference characters as used above to describe the exemplary embodiments of the method of driving the display apparatus shown in FIGS. 12 and 32, and any repetitive detailed description thereof will hereinafter be omitted or simplified.

In FIG. 34, a method of driving the transparent sub pixel T and a method of driving the first and second subpixels G and B are shown.

Referring to FIGS. 31 and 34, the display panel 100 displays green and blue using the first and second subpixels G and B and white light of the first light source 210. The display panel 100 displays red using the white light of the first light source 210 and red light of the second light source 220.

In an exemplary embodiment of the method of driving the display panel 100, the panel driver 300 sets same grayscale data of the first and second subpixels G and B during the first and second subframes SF1 and SF2.

According to an exemplary embodiment, as described above, the first and second subpixels G and B are precharged during the first subframe SF1 such that the display panel 100 may effectively display a predetermined grayscale, and the display quality is thereby improved.

Figure 35A:
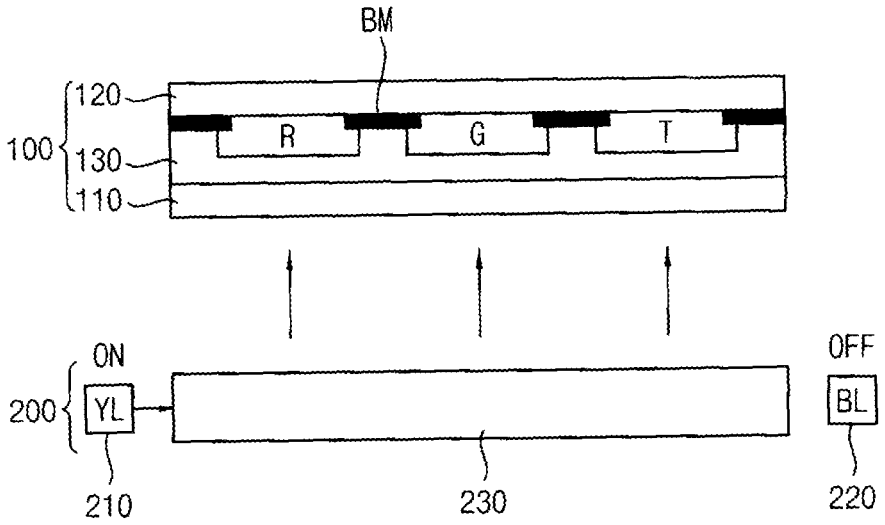
FIG. 35A is a cross-sectional view of a display panel and a light source part of another alternative exemplary embodiment of a display apparatus according to the invention in a first subframe.
Figure 35B:
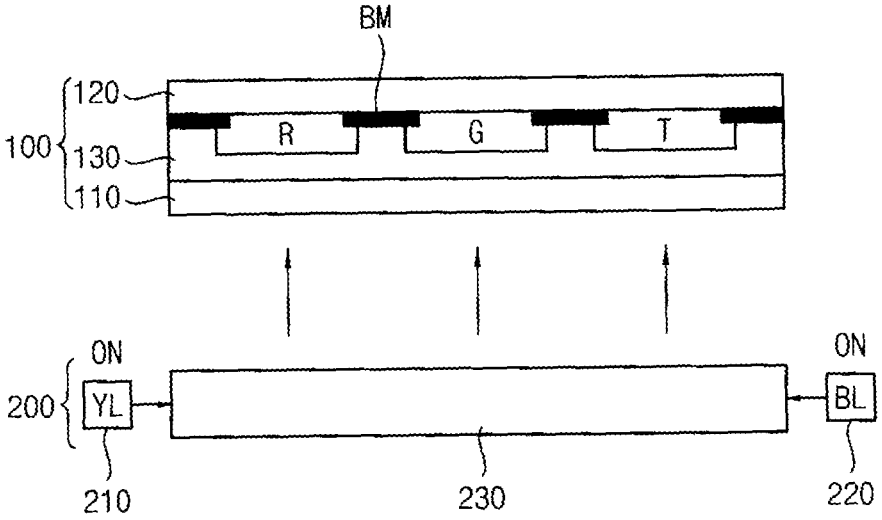
FIG. 35B is a cross-sectional view the display panel and the light source part of the display apparatus of FIG. 35A in a second subframe.

FIG. 35A is a cross-sectional view of a display panel and a light source part of another alternative exemplary embodiment of a display apparatus according to the invention in a first subframe. FIG. 35B is a cross-sectional view of the display panel and the light source part the display apparatus of FIG. 35A in a second subframe.

The display apparatus shown in FIGS. 35A and 35B is substantially the same as the display apparatus in FIGS. 1 to 3B except that a first light source and a second light source are turned on during a second subframe. The same or like elements shown in FIGS. 35A and 35B have been labeled with the same reference characters as used above to describe the exemplary embodiment of the display apparatus shown in FIGS. 1 to 3B, and any repetitive detailed description thereof will hereinafter be omitted or simplified.

Referring to FIGS. 1, 2, 35A and 35B, the display apparatus includes a display panel 100, a light source part 200, a panel driver 300 and a light source driver 400.

The display panel 100 includes a first subpixel R having a first primary color, a second subpixel G having a second primary color and a transparent subpixel T.

In an exemplary embodiment, as shown in FIGS. 35A and 35B, the first primary color may be red, and the first subpixel R may be a red subpixel. In such an embodiment, the second primary color may be green, and the second subpixel G may be a green subpixel. In an alternative exemplary embodiment, the first primary color may be red, the first subpixel may be a red subpixel, the second primary color may be blue, and the second subpixel may be a blue subpixel. In an alternative exemplary embodiment, the first primary color may be green, the first subpixel may be a green subpixel, the second primary color may be blue, and the second subpixel may be a blue subpixel.

In an exemplary embodiment, the first subpixel R may be defined by a red color filter disposed on the second substrate 120. The second subpixel G may be defined by a green color filter disposed on the second substrate 120. The transparent subpixel T may be defined by a transparent color filter disposed on the second substrate 120. In one exemplary embodiment, for example, the transparent color filter may be defined by a substantially empty space at which no color filter is disposed. A light blocking pattern BM may be disposed between the color filters.

The panel driver 300 sets grayscale data of the first, second and transparent subpixels R, G and T.

The light source part 200 includes a first light source 210 and a second light source 220, which have colors different from each other. The light source part 200 may further include a light guide plate 230. The light source part 200 generates light and provides the light to the display panel 100.

The first light source 210 generates light having a mixed color of the first primary color and the second primary color. In an exemplary embodiment, as shown in FIGS. 35A and 35B, the first primary color is red, the second primary color is green, and the mixed color of the first and second primary colors is yellow. In an alternative exemplary embodiment, the mixed color of the first and second primary colors may be magenta. In an alternative exemplary embodiment, the mixed color of the first and second primary colors may be cyan. In an alternative exemplary embodiment, the first light source 210 may generate white light. The second light source 220 generates light having a third primary color.

The light source driver 400 is connected to the light source part 200. The light source driver 400 drives the light source part 200. The light source driver 400 repeatedly turns on and off at least one of the first and second light sources 210 and 220.

In an exemplary embodiment, as shown in FIGS. 35A and 35B, the first light source 210 may be continuously turned on. In such an embodiment, the second light source 220 may be repeatedly turned on and off.

In an exemplary embodiment, during a first subframe, the first light source 210 is turned on and the second light source 220 is turned off. During a second subframe, the first light source 210 and the second light source 220 are turned on.

The panel driver 300 operates subpixel rendering to set grayscale data of the first subpixel R, the second subpixel G and the transparent subpixel T.

In one exemplary embodiment, for example, when the display panel 100 displays a white grayscale of 100 grayscale level, during the first subframe, the panel driver 300 may set a grayscale of the first primary color to 20 grayscale level and a grayscale of the second primary color to 20 grayscale level. The first light source 210 may generate the mixed light corresponding to 20 grayscale level, and the transparent subpixel T may fully transmit the mixed light from the first light source 210.

During the second subframe, the panel driver 300 may set the grayscale of the first primary color to 30 grayscale level, and the grayscale of the second primary color to 30 grayscale level. The first light source 210 may generate the mixed light corresponding to 30 grayscale level, the second light source 220 may generate the light of the third primary color corresponding to 100 grayscale level, and the transparent subpixel T may fully transmit the light from the first and second light sources 210 and 220.

As described above, in an exemplary embodiment, 20 grayscale level is displayed in the first subframe and 30 grayscale level is displayed in the second subframe, but the grayscales in the first and second subframes are limited thereto. The grayscales in the first and second subframes may be set such that a mixed image represents a predetermined white grayscale.

According to an exemplary embodiment, the display panel 100 includes red, green and transparent subpixels R, G and T, and the light source part 200 includes a blue light source BL, which is repeatedly turned on and off, such that the power consumption of the display apparatus substantially decreases.

Figure 36A:
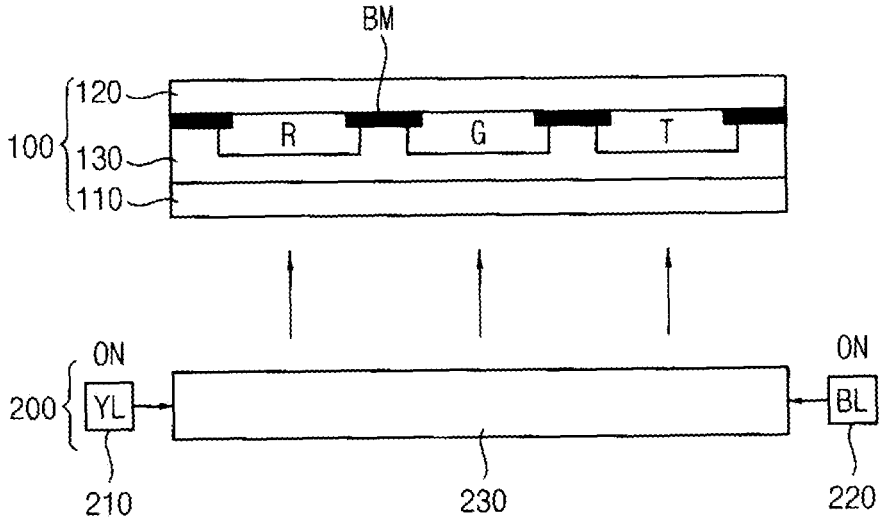
FIG. 36A is a cross-sectional view of a display panel and a light source part of another alternative exemplary embodiment of a display apparatus according to the invention in a first subframe.
Figure 36B:
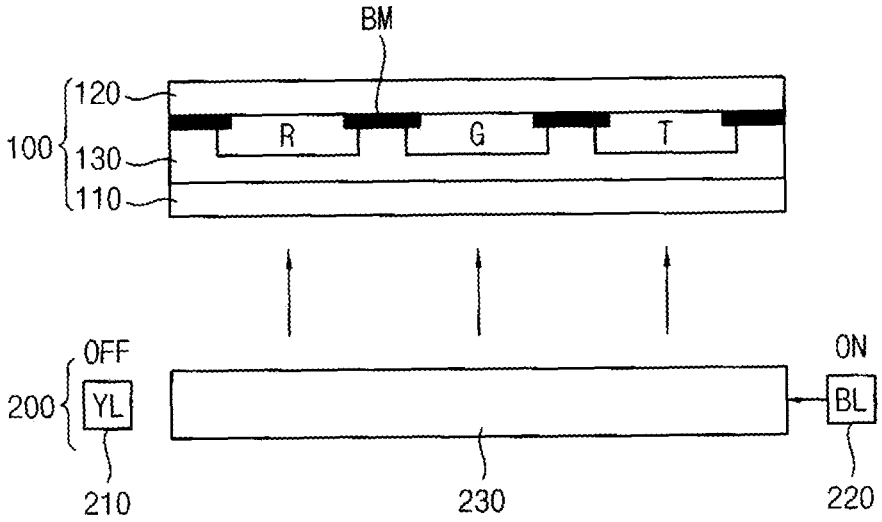
FIG. 36B is a cross-sectional view the display panel and the light source part of the display apparatus of FIG. 36A in a second subframe.

FIG. 36A is a cross-sectional view of a display panel and a light source part of another alternative exemplary embodiment of a display apparatus according to the invention in a first subframe. FIG. 36B is a cross-sectional view of the display panel and the light source part of the display apparatus of FIG. 36A in a second subframe.

The display apparatus shown in FIGS. 36A and 36B is substantially the same as the display apparatus in FIGS. 1 to 3B except that a first light source and a second light source are turned on during a first subframe. The same or like elements shown in FIGS. 36A and 36B have been labeled with the same reference characters as used above to describe the exemplary embodiment of the display apparatus shown in FIGS. 1 to 3B, and any repetitive detailed description thereof will hereinafter be omitted or simplified.

Referring to FIGS. 1, 2, 36A and 36B, the display apparatus includes a display panel 100, a light source part 200, a panel driver 300 and a light source driver 400.

The display panel 100 includes a first subpixel R having a first primary color, a second subpixel G having a second primary color and a transparent subpixel T.

In an exemplary embodiment, as shown in FIGS. 36A and 36B, the first primary color may be red, and the first subpixel R may be a red subpixel. In such an embodiment, the second primary color may be green, and the second subpixel G may be a green subpixel. In an alternative exemplary embodiment, the first primary color may be red, the first subpixel may be a red subpixel, the second primary color may be blue, and the second subpixel may be a blue subpixel. In an alternative exemplary embodiment, the first primary color may be green, the first subpixel may be a green subpixel, the second primary color may be blue, and the second subpixel may be a blue subpixel.

In an exemplary embodiment, the first subpixel R may be defined by a red color filter disposed on the second substrate 120. The second subpixel G may be defined by a green color filter disposed on the second substrate 120. The transparent subpixel T may be defined by a transparent color filter disposed on the second substrate 120. In one exemplary embodiment, for example, the transparent color filter may be defined by a substantially empty space at which no color filter is disposed. A light blocking pattern BM may be disposed between the color filters.

The panel driver 300 sets grayscale data of the first, second and transparent subpixels R, G and T.

The light source part 200 includes a first light source 210 and a second light source 220 which have colors different from each other. The light source part 200 may further include a light guide plate 230. The light source part 200 generates light and provides the light to the display panel 100.

The first light source 210 generates light having a mixed color of the first primary color and the second primary color. In an exemplary embodiment, as shown in FIGS. 36A and 36B, the first primary color is red, the second primary color is green, and the mixed color of the first and second primary colors is yellow. In an alternative exemplary embodiment, the mixed color of the first and second primary colors may be magenta. In another alternative exemplary embodiment, the mixed color of the first and second primary colors may be cyan. In another alternative exemplary embodiment, the first light source 210 may generate white light. The second light source 220 generates light having a third primary color.

The light source driver 400 is connected to the light source part 200. The light source driver 400 drives the light source part 200. The light source driver 400 repeatedly turns on and off at least one of the first and second light sources 210 and 220.

In an exemplary embodiment, the second light source 220 may be continuously turned on. In an alternative exemplary embodiment, the first light source 210 may be repeatedly turned on and off.

In the exemplary embodiment, during a first subframe, the first light source 210 and the second light source 220 are turned on. During a second subframe, the first light source 210 is turned off and the second light source 220 is turned on.

The panel driver 300 operates subpixel rendering to set grayscale data of the first subpixel R, the second subpixel G and the transparent subpixel T.

In one exemplary embodiment, for example, when the display panel 100 represents a white grayscale of 100 grayscale level, during the first subframe, the panel driver 300 may set a grayscale of the first primary color to 50 grayscale level and a grayscale of the second primary color to 50 grayscale level. The first light source 210 may generate the mixed light corresponding to 50 grayscale level, the second light source 220 may generate the light of the third primary color corresponding to 50 grayscale level, and the transparent subpixel T may fully transmit the light from the first and second light sources 210 and 220.

During the second subframe, the panel driver 300 may set the grayscale of the first primary color to zero (0) grayscale level and the grayscale of the second primary color to zero (0) grayscale. The second light source 220 may generate the mixed light corresponding to 50 grayscale level, and the transparent subpixel T may fully transmit the light from the second light source 220.

According to an exemplary embodiment, the display panel 100 includes red, green and transparent subpixels R, G and T, and the light source part 200 includes a yellow light source YL, which is repeatedly turned on and off, such that the power consumption of the display apparatus substantially decreases.

According to exemplary embodiments of the invention, as described above, the display panel includes subpixels having primary colors and a transparent subpixel, and the light source part includes a light source having a primary color, which is different from the primary colors of the subpixels in the display panel, such that a power consumption of the display apparatus substantially decreases.

The foregoing is illustrative of the invention and is not to be construed as limiting thereof. Although a few example embodiments of the invention have been described, those skilled in the art will readily appreciate that many modifications are possible in the example embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific example embodiments disclosed, and that modifies to the disclosed example embodiments, as well as other example embodiments, are intended to be included within the scope of the appended claims. The invention is defined by the following claims, with equivalents of the claims to be included therein.

What is claimed is:

1. A display apparatus comprising:

a display panel comprising:

a first subpixel having a first primary color;

a second subpixel having a second primary color; and a transparent subpixel;

a panel driver which sets grayscale data of the first subpixel, the second subpixel and the transparent subpixel;

a light source part which provides light to the display panel, wherein the light source part comprises a first light source and a second light source having colors different from each other; and a light source driver which turns on the first light source and turns off the second light source during a first subframe, turns on the second light source and turns off the first light source during a second subframe, and turns on the first light source and turns off the second light source during a third subframe, wherein a first frame comprises the first subframe, the second subframe and the third subframe being contiguous to one another, the display panel displays an image at a frame rate of a first frequency, and the light source driver alternately turns on the first and second light sources at a second frequency less than the first frequency.

2. The display apparatus of claim 1, wherein a second frame comprises a fourth subframe, a fifth subframe and a sixth subframe, and the light source driver turns on the second light source during the fourth subframe, turns on the first light source during the fifth subframe, and turns on the second light source during the sixth subframe.

3. The display apparatus of claim 2, wherein a third frame comprises a seventh subframe, an eighth subframe and a ninth subframe, a fourth frame comprises a tenth subframe, an eleventh subframe and a twelfth subframe, the light source driver turns on the first light source during the seventh subframe, turns on the second light source during the eighth subframe, turns on the first light source during the ninth subframe, turns on the second light source during the tenth subframe, turns on the first light source during the eleventh subframe, and turns on the second light source during the twelfth subframe, and the light source driver controls the first light source to emit light of a first intensity during the first, fifth and seventh subframes and to emit light of a second intensity greater than the first intensity during the third, ninth and eleventh subframes in response to a same grayscale data.

4. The display apparatus of claim 3, wherein the light source driver controls the second light source to emit light of a third intensity during the fourth, eighth and tenth subframes and to emit light of a fourth intensity greater than the third intensity during the second, sixth and twelfth subframes in response to the same grayscale data.

5. The display apparatus of claim 3, wherein the first intensity is about one third of the second intensity corresponding to the same grayscale data.

6. The display apparatus of claim 1, wherein the display panel displays an image at a frame rate of about 180 hertz, and the light source driver alternately turns on the first and second light sources at a frequency of about 120 hertz.

7. The display apparatus of claim 1, wherein a turn-on timing of the first light source in the first subframe is delayed with respect to a turn-on timing of the second light source in the second subframe.

8. The display apparatus of claim 1, wherein a turn-on timing of the first light source in the third subframe is shifted forward with respect to a turn-on timing of the second light source in the second subframe.

9. The display apparatus of claim 1, wherein the first light source generates light having a mixed color of the first primary color and the second primary color, and the second light source generates light having a third primary color.

10. The display apparatus of claim 9, wherein the mixed color is yellow, and the third primary color is blue.

11. The display apparatus of claim 9, wherein the mixed color is magenta, and the third primary color is green.

12. The display apparatus of claim 9, wherein the mixed color is cyan, and the third primary color is red.

13. The display apparatus of claim 1, wherein the first light source generates white light, and the second light source generates light having a third primary color.

14. A display apparatus comprising:

a display panel comprising:

a first subpixel having a first primary color;

a second subpixel having a second primary color; and a transparent subpixel;

a panel driver which sets grayscale data of the first subpixel, the second subpixel and the transparent subpixel;

a light source part which provides light to the display panel, wherein the light source part comprises a first light source and a second light source having colors different from each other; and a light source driver which turns on the first light source and turns off the second light source during a first subframe, turns on the second light source and turns off the first light source during a second subframe, and turns on the first light source and turns off the second light source during a third subframe, wherein a first frame comprises the first subframe, the second subframe and the third subframe being contiguous to one another, wherein a second frame comprises a fourth subframe, a fifth subframe and a sixth subframe, and the light source driver turns on the second light source during the fourth subframe, turns on the first light source during the fifth subframe, and turns on the second light source during the sixth subframe, and wherein an intensity of the first light source during the first and third subframes is less than an intensity of the first light source during the fifth subframe in response to a same grayscale data.

15. The display apparatus of claim 14, wherein an intensity of the second light source during the fourth and sixth subframes is less than an intensity of the second light source during the second subframe in response to the same grayscale data.

16. The display apparatus of claim 14, wherein the intensity of the first light source during the first and third subframes is about half of the intensity of the first light source during the fifth subframe corresponding to the same grayscale data.

17. A method of driving a display apparatus, the method comprising:

setting grayscale data of a first subpixel having a first primary color, a second subpixel having a second primary color and a transparent subpixel; and turning on a first light source and turning off a second light source during a first subframe of a frame;

turning on the second light source having a color different from a color of the first light source and turning off the first light source during a second subframe of the frame; and turning on the first light source and turning off the second light source during a third subframe of the frame, wherein the first subframe, the second subframe and the third subframe are contiguous to one another, the display panel displays an image at a frame rate of a first frequency, and the light source driver alternately turns on the first and second light sources at a second frequency less than the first frequency.

* * * * *